US007971881B2

(12) United States Patent
Toyama et al.

(10) Patent No.: US 7,971,881 B2
(45) Date of Patent: Jul. 5, 2011

(54) APPARATUS AND METHOD FOR AUTOMATICALLY SHUFFLING CARDS

(75) Inventors: Hirohide Toyama, Darien, IL (US); Stephen C. Jones, Chicago, IL (US)

(73) Assignee: Shuffle Tech International LLC, Chicago, IL (US)

( * ) Notice: Subject to any disclaimer, the term of this patent is extended or adjusted under 35 U.S.C. 154(b) by 0 days.

(21) Appl. No.: 12/151,358

(22) Filed: May 6, 2008

(65) Prior Publication Data

US 2008/0284096 A1 Nov. 20, 2008

Related U.S. Application Data

(63) Continuation-in-part of application No. 11/706,707, filed on Feb. 15, 2007, and a continuation-in-part of application No. 29/294,563, filed on Jan. 17, 2008, now Pat. No. Des. 578,577.

(60) Provisional application No. 60/775,260, filed on Feb. 21, 2006.

(51) Int. Cl.
*A63F 1/12* (2006.01)

(52) U.S. Cl. ..... 273/149 R; 273/148 R; 273/292; 463/11; 463/12; 463/25; 463/29; 209/534; 209/547; 209/554

(58) Field of Classification Search ..... 273/149 R, 273/292, 148 R; 463/11, 12, 25, 29; 209/534, 209/547, 554
See application file for complete search history.

(56) References Cited

U.S. PATENT DOCUMENTS 1,955,926 A 4/1934 Matthaey
2,001,220 A 5/1935 Smith
2,159,958 A * 5/1939 Sachs ..... 273/149 R
2,430,681 A 11/1947 Johnson
2,706,117 A 4/1955 Notz
2,711,319 A 6/1955 Morgan et al.
2,714,510 A 8/1955 Oppenlander et al.
2,717,782 A * 9/1955 Droll ..... 273/149 R
2,727,747 A 12/1955 Semisch, Jr.
2,747,877 A * 5/1956 Howard ..... 273/149 R
2,753,185 A 7/1956 Johnson
2,755,090 A 7/1956 Aldrich (Continued)

FOREIGN PATENT DOCUMENTS

JP 2001327647 A 11/2001

OTHER PUBLICATIONS

Apr. 15, 2009 Non-Final Office Action, U.S. Appl. No. 11/706,707 (32 pages).

(Continued)

*Primary Examiner* — Gene Kim
*Assistant Examiner* — Alexander R Niconovich
(74) *Attorney, Agent, or Firm* — Brinks Hofer Gilson & Lione

(57) ABSTRACT

An apparatus and method of automatically shuffling a deck of playing cards is described. The apparatus includes three compartments disposed laterally with respect to each other and at least one compartment movable vertically with respect to another other compartment. Cards placed in one of the compartments are dispensed into the other two compartments so as to cut or strip the deck, and are returned to the original compartment by interleaving cards from the other compartments. The process may be repeated to substantially randomize the deck for use in playing a game of cards. The cards may be removed either through a top aperture through which the cards were introduced into the apparatus or using a removable tray.

21 Claims, 27 Drawing Sheets

U.S. PATENT DOCUMENTS

| | | | | |
|---|---|---|---|---|
| 2,815,214 | A | 12/1957 | Hall | |
| 3,067,885 | A | 12/1962 | Kohler | |
| 3,147,978 | A | 9/1964 | Sjöstrand | |
| 3,305,237 | A * | 2/1967 | Granius | 273/149 R |
| 3,588,116 | A | 6/1971 | Miura | |
| 3,589,730 | A | 6/1971 | Slay | |
| D224,658 | S | 8/1972 | Cole et al. | |
| 3,975,010 | A | 8/1976 | Schisselbauer et al. | |
| 4,310,160 | A * | 1/1982 | Willette et al. | 273/149 R |
| 4,497,488 | A | 2/1985 | Plevyak et al. | |
| 4,513,969 | A * | 4/1985 | Samsel, Jr. | 273/149 R |
| 4,515,367 | A * | 5/1985 | Howard | 273/149 R |
| 4,586,712 | A * | 5/1986 | Lorber et al. | 273/149 R |
| 4,692,748 | A * | 9/1987 | Pinsak et al. | 340/573.1 |
| 4,770,421 | A * | 9/1988 | Hoffman | 273/149 R |
| 4,807,884 | A * | 2/1989 | Breeding | 273/149 R |
| 4,832,342 | A * | 5/1989 | Plevyak et al. | 273/149 R |
| 4,951,950 | A | 8/1990 | Normand et al. | |
| 4,969,648 | A * | 11/1990 | Hollinger et al. | 273/149 R |
| 5,000,453 | A * | 3/1991 | Stevens et al. | 273/149 R |
| 5,261,667 | A * | 11/1993 | Breeding | 273/149 R |
| 5,344,146 | A | 9/1994 | Lee | |
| 5,356,145 | A * | 10/1994 | Verschoor | 273/149 R |
| 5,382,024 | A | 1/1995 | Blaha | |
| 5,397,133 | A | 3/1995 | Penzias | |
| 5,431,399 | A * | 7/1995 | Kelley | 273/149 P |
| 5,445,377 | A * | 8/1995 | Steinbach | 273/149 R |
| 5,575,475 | A | 11/1996 | Steinbach | |
| 5,584,483 | A | 12/1996 | Sines et al. | |
| 5,676,372 | A | 10/1997 | Sines et al. | |
| 5,692,748 | A * | 12/1997 | Frisco et al. | 273/149 R |
| 5,695,189 | A * | 12/1997 | Breeding et al. | 273/149 R |
| 5,718,427 | A * | 2/1998 | Cranford et al. | 273/149 R |
| 5,820,334 | A * | 10/1998 | Darcy et al. | 414/798.1 |
| 5,944,310 | A | 8/1999 | Johnson et al. | |
| 5,989,122 | A | 11/1999 | Roblejo | |
| 6,019,368 | A | 2/2000 | Sines et al. | |
| 6,068,258 | A * | 5/2000 | Breeding et al. | 273/149 R |
| D432,588 | S | 10/2000 | Tedham | |
| 6,139,014 | A * | 10/2000 | Breeding et al. | 273/149 R |
| 6,149,154 | A | 11/2000 | Grauzer et al. | |
| 6,189,880 | B1 * | 2/2001 | Besold | 270/58.25 |
| 6,250,632 | B1 * | 6/2001 | Albrecht | 273/149 R |
| 6,254,096 | B1 | 7/2001 | Grauzer et al. | |
| 6,299,167 | B1 * | 10/2001 | Sines et al. | 273/149 R |
| 6,325,373 | B1 * | 12/2001 | Breeding et al. | 273/149 R |
| 6,568,678 | B2 * | 5/2003 | Breeding et al. | 273/149 R |
| 6,588,750 | B1 | 7/2003 | Grauzer et al. | |
| 6,588,751 | B1 | 7/2003 | Grauzer et al. | |
| 6,651,981 | B2 * | 11/2003 | Grauzer et al. | 273/149 R |
| 6,651,982 | B2 | 11/2003 | Grauzer et al. | |
| 6,655,684 | B2 | 12/2003 | Grauzer et al. | |
| 6,659,460 | B2 | 12/2003 | Blaha et al. | |
| 6,676,127 | B2 | 1/2004 | Johnson et al. | |
| 6,698,756 | B1 | 3/2004 | Baker et al. | |
| D488,193 | S | 4/2004 | Girard | |
| D490,481 | S | 5/2004 | Hessing | |
| 6,886,829 | B2 | 5/2005 | Hessing et al. | |
| 6,889,979 | B2 | 5/2005 | Blaha et al. | |
| 6,926,271 | B2 * | 8/2005 | Hanson et al. | 271/213 |
| 6,959,925 | B1 | 11/2005 | Baker et al. | |
| 7,036,818 | B2 * | 5/2006 | Grauzer et al. | 273/149 R |
| 7,059,602 | B2 * | 6/2006 | Grauzer et al. | 273/149 R |
| 7,066,464 | B2 | 6/2006 | Blad et al. | |
| 7,073,791 | B2 * | 7/2006 | Grauzer et al. | 273/149 R |
| 7,264,140 | B1 | 9/2007 | Stoddard et al. | |
| 7,413,191 | B2 * | 8/2008 | Grauzer et al. | 273/149 R |
| D578,577 | S | 10/2008 | Toyama | |
| 7,510,194 | B2 * | 3/2009 | Soltys et al. | 273/293 |
| 7,523,935 | B2 * | 4/2009 | Grauzer et al. | 273/149 R |
| 7,540,497 | B2 | 6/2009 | Tseng | |
| 7,556,266 | B2 * | 7/2009 | Blaha et al. | 273/149 R |
| 7,584,962 | B2 * | 9/2009 | Breeding et al. | 273/149 R |
| 7,677,565 | B2 * | 3/2010 | Grauzer et al. | 273/149 R |
| 7,766,333 | B1 | 8/2010 | Stardust et al. | |
| 2002/0063389 | A1 * | 5/2002 | Breeding et al. | 273/292 |
| 2002/0070499 | A1 * | 6/2002 | Breeding et al. | 273/149 R |
| 2003/0073498 | A1 * | 4/2003 | Grauzer et al. | 463/42 |
| 2004/0067789 | A1 * | 4/2004 | Grauzer et al. | 463/11 |
| 2004/0108255 | A1 | 6/2004 | Johnson | |
| 2004/0224777 | A1 | 11/2004 | Smith et al. | |
| 2005/0110210 | A1 | 5/2005 | Soltys et al. | |
| 2005/0140090 | A1 * | 6/2005 | Breeding et al. | 273/149 R |
| 2005/0206077 | A1 | 9/2005 | Grauzer et al. | |
| 2006/0220312 | A1 * | 10/2006 | Baker et al. | 273/149 R |
| 2006/0220313 | A1 * | 10/2006 | Baker et al. | 273/149 R |
| 2007/0057453 | A1 * | 3/2007 | Soltys et al. | 273/149 P |
| 2007/0069462 | A1 * | 3/2007 | Downs et al. | 273/149 R |
| 2007/0102879 | A1 * | 5/2007 | Stasson | 273/149 R |
| 2007/0194524 | A1 * | 8/2007 | Toyama et al. | 273/149 R |
| 2007/0267811 | A1 * | 11/2007 | Yoseloff et al. | 273/149 P |
| 2007/0273094 | A1 * | 11/2007 | Fleckenstein | 273/149 P |
| 2007/0273099 | A1 | 11/2007 | Fleckenstein | |
| 2007/0278739 | A1 * | 12/2007 | Swanson | 273/149 R |
| 2007/0296150 | A1 * | 12/2007 | Grauzer et al. | 273/292 |
| 2008/0113700 | A1 * | 5/2008 | Czyzewski et al. | 463/11 |
| 2008/0315517 | A1 * | 12/2008 | Toyama | 273/149 R |
| 2009/0072477 | A1 * | 3/2009 | Tseng | 273/149 R |
| 2009/0191933 | A1 * | 7/2009 | French | 463/12 |
| 2009/0243213 | A1 * | 10/2009 | Pececnik et al. | 273/149 R |
| 2009/0283969 | A1 * | 11/2009 | Tseng | 273/149 R |

OTHER PUBLICATIONS

Response to Apr. 15, 2009 Non-Final Office Action, U.S. Appl. No. 11/706,707, filed in the PTO on May 1, 2009 (10 pages).

Written Opinion of the International Searching Authority from the International Search Report from PCT application No. PCT/US2008/064628 dated Oct. 28, 2008, 5 pages.

International Search Report for International Application No. PCT/US2008/064628, dated Oct. 28, 2008, 3 pages.

John N. Hansen Co., "Four Deck Automatic Card Shuffler," AreYouGame.com, obtained at the Internet address: http://www.areyougame.com/Interact/search.asp?qmethod=0&q=jhb232, 1 page.

Home Casino Games, Online Gamblers Gift Shop, "Card Shufflers," obtained at the Internet address: http://www.homecasinogames.com/Catalog/ItemList.cfm?CategoryId=874, 2 pages.

Opamerica, Excalibur Electronics WSOP Pro Shuffle (425-WSOP), obtained at the Internet address: http://www.opamerica.com/product_info.php/products_id/869, 1 page.

International Search Report from PCT international application No. PCT/US2007/004509 dated Oct. 4, 2007 (4 pages).

Response to Jun. 5, 2009 Non-Final Office Action, U.S. Appl. No. 11/706,707, filed in the PTO on Jun. 30, 2009 (17 pages).

PCT Notification of Transmittal of the International Preliminary Report on Patentability from PCT International Application No. PCT/US2007/004509 dated Sep. 4, 2008 (7 pages).

Jun. 5, 2009 Final Office Action, U.S. Appl. No. 11/706,707 (23 pages).

Aug. 12, 2009 Final Office Action, U.S. Appl. No. 11/706,707 (34 pages).

Response to Aug. 12, 2009 Final Office Action, U.S. Appl. No. 11/706,707, filed in the PTO on Sep. 1, 2009 (25 pages).

Nov. 6, 2009 Non-Final Office Action, U.S. Appl. No. 11/706,707 (27 pages).

Response to Nov. 6, 2009 Non-Final Office Action, U.S. Appl. No. 11/706,707, filed in the PTO on Dec. 21, 2009 (17 pages).

Written Opinion of the International Searching Authority from the International Search Report from PCT application No. PCT/US2009/042927 dated Feb. 23, 2010, 6 pages.

International Search Report for International Application No. PCT/US2009/042927, dated Feb. 23, 2010, 8 pages.

Mar. 23, 2010 Final Office Action, U.S. Appl. No. 11/706,707 (37 pages).

Response to Mar. 23, 2010 Final Office Action, U.S. Appl. No. 11/706,707, filed in the PTO on Sep. 23, 2010 (36 pages).

* cited by examiner

SECTION A-A

SECTION B-B

SECTION C-C

| RCN | Task | Parameter |
|---|---|---|
| 1 | cut | odd |
| 2 | strip | R |
| 3 | cut | odd |
| 4 | cut | even |
| 5 | strip | L |
| 6 | cut | even |
| 7 | cut | odd |
| 8 | cut | even |
| 9 | cut | odd |

APPARATUS AND METHOD FOR AUTOMATICALLY SHUFFLING CARDS

This application is a continuation-in-part of U.S. Ser. No. 11/706,707, filed on Feb. 15, 2007 which claims the benefit of US provisional application Ser. No. 60/775,260, filed on Feb. 21, 2006, each of which is incorporated herein by reference. This application is also a continuation-in-part of, and claims priority to, U.S. design patent application 29/294,563, filed on Jan. 17, 2008 now U.S. Pat. No. D,578,577, which is incorporated herein by reference.

TECHNICAL FIELD

This application relates to an apparatus and method for automatically preparing playing cards for use, and in particular for the cutting, riffling and stripping operations performed in shuffling cards.

BACKGROUND

Various games are played using playing cards, where a typical game may use one or more decks, which may have 52 cards of various values and suits. Other card games may use different numbers of cards, and some games may be played with multiple decks of cards. Examples of such games are poker, blackjack, bridge, canasta, preference, pinochle and the like. Players of such games have an interest in ensuring that the playing cards are dispensed for the playing of a game in a random manner, giving no one player an unfair advantage. Preparing a deck of cards may be accomplished either manually or automatically. In the case of manual preparation, the cards may be cut, riffled and stripped. This process is generically termed "shuffling" the cards, and may be performed multiple times to prepare the deck. It is believed that performing a cut-riffle process approximately 7 times will result in a sufficiently random distribution of cards within a deck. However this is time consuming and, except in professional games, it is common to perform the shuffling process only 2-4 times. Various mechanical means of performing operations which may have the effect of randomizing the deck of cards are known. Such mechanical means may not replicate the actions of a dealer performing manual shuffling, or may be cumbersome to use and expensive, being typically intended for use in a casino.

SUMMARY

A device for shuffling a deck of cards is disclosed including a first compartment, a second compartment, a third compartment; and a card delivery compartment. A transport mechanism of the first compartment is operable to dispense cards from the first compartment to at least one of the second or third compartments and a transport mechanism of at least one of the second or the third compartments is operable to dispense cards from at least one of the second and third compartments to the first compartment. The cards may be dispensed into the card delivery compartment or removed from the device through a top aperture.

In another aspect, a card shuffling device has a central compartment; a right-hand compartment; and, a left hand compartment. The central compartment is movable in a vertical direction with respect to the right-hand and left-hand compartments, and each compartment has a transport mechanism for moving cards disposable in the compartment from the bottom of the compartment to a top aperture in another compartment.

In yet another aspect, a method for shuffling a deck of cards is described, the method including the steps of: providing a first, a second and a third compartment; transferring a portion of a deck of cards from the a bottom of the first compartment into the second compartment; transferring a portion of a deck of cards from the bottom of the first compartment into the second compartment; and transferring cards from a bottom of the second and third compartments to the first compartment.

DETAILED DESCRIPTION

Exemplary embodiments may be better understood with reference to the drawings, but these examples are not intended to be of a limiting nature. Like numbered elements in the same or different drawings perform equivalent functions.

Figure 2A:
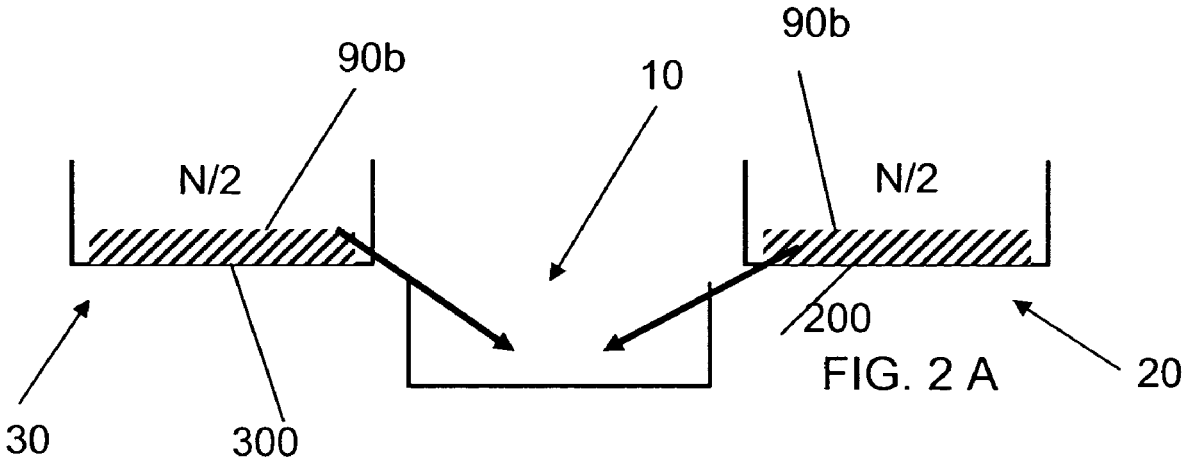
FIG. 2A-B is a conceptual diagram showing a riffle operation on a deck of cards.
Figure 2B:
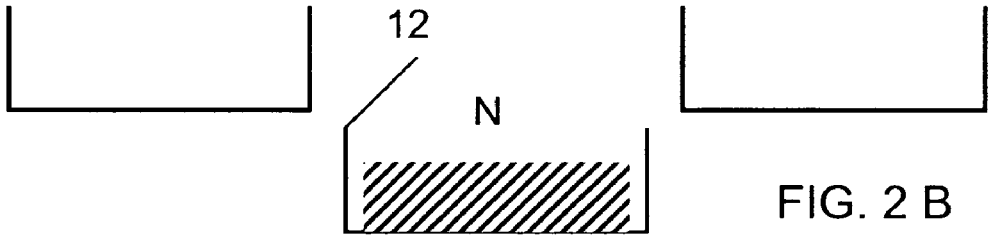
Figure 3A:
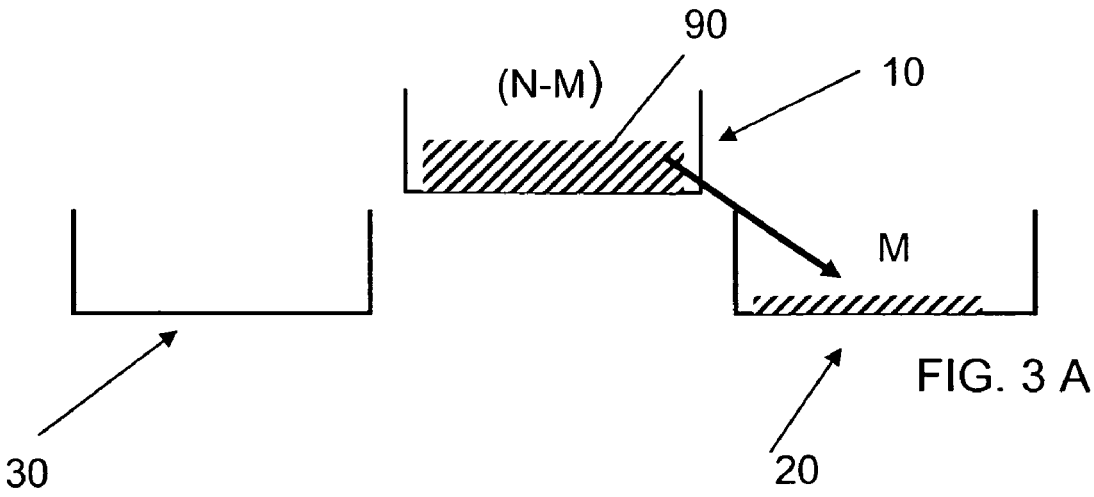
FIG. 3A-C is a conceptual diagram showing a stripping operation on a deck of cards.
Figure 3B:
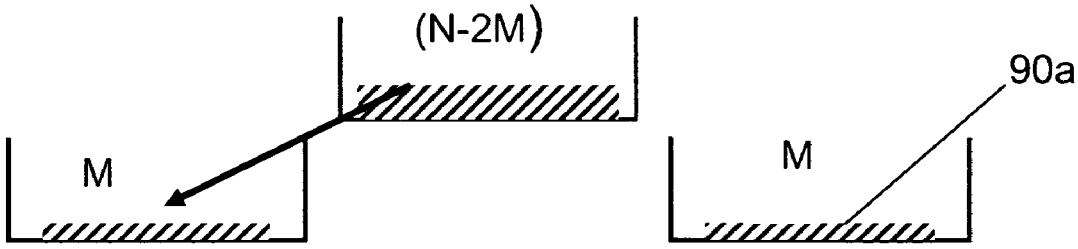
Figure 3C:
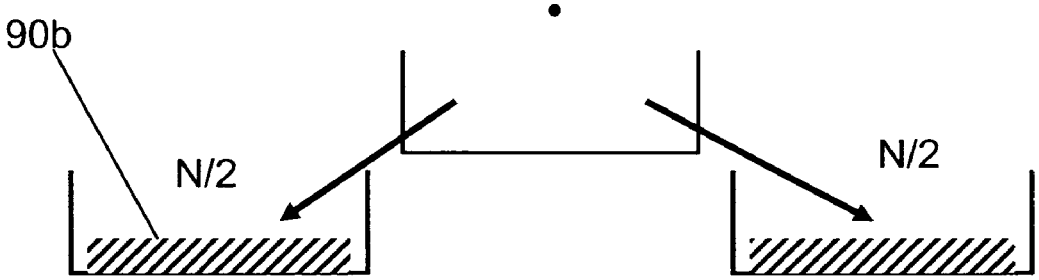

The terminology and general arrangement of the automatic card shuffling device is illustrated in FIGS. 1 through 3 in elevation cross-sectional views. The device may be intended for, and dimensioned for use with, a single deck of cards. Alternatively, the device may be dimensioned for use with multiple decks of cards, although a device dimensioned for multiple decks of cards may also be suitable for shuffling a single deck of cards. Generally, the difference between such configurations is the height of the compartments used to hold the cards. The subsequent discussion will describe a single deck of cards, for clarity; however, unless otherwise excluded, the operations are equally possible for a stack of cards comprising more than one deck of cards.

The operations performed by the device include:

(a) cutting or splitting: an operation by which a deck of cards is divided approximately into two portions or stacks of cards;

(b) riffling: an operation by which the two portions or stacks obtained by cutting the deck are recombined by approximately moving a card from each of the two portions into a resultant single stack, where the cards are moved alternately from each portion to a single stack;

(c) stripping: an operation similar to cutting, in which an approximately predetermined number of cards is moved from the initial stack to a first stack, a similar number of cards is moved to a second stack, and the process is repeated until the initial stack of cards has been completely moved to the first and second stacks.

Commonly, the performance of step (a) followed by steps (b), or step (c) followed by step (b), or the like, is termed "shuffling" the cards, and may be performed multiple times. Not all of the steps need be performed however. For example, steps (a) and (b), or steps (b) and (c) may be performed, without the third step.

As shown in FIG. 1, the automatic card shuffling device may have three card-holding compartments: a left-hand compartment 30, a right-hand compartment 20 and a central compartment 10. The compartments are capable of being moved vertically with respect to each other. Generally, the left-hand and right-hand compartments may be maintained so that they are at the same level with respect to a base portion of the device, and the central compartment may be movable in a vertical direction. Although the device may be constructed such that only the central compartment moves vertically, a more compact vertical arrangement may result when more than one of the compartments is capable of vertical motion. The central compartment 10 is sized and dimensioned so as to be capable of accommodating at least one deck of playing cards 90, and the left-hand and the right-hand compartments 30 and 20 are sized and dimensioned so as to be capable of accommodating at least half of the contents of the central compartment 10.

The mechanisms shown in the figures are enclosed in an outer housing or shell (not shown) as would be conventional for a device having moving parts. Apertures for receiving or dispensing cards, connection of electrical power, or the like, would be provided, as will be apparent to a person of ordinary skill in the art. The housing may provide structural support for portions of the mechanism, and mounting provisions for electronics for controlling the operation of the card shuffling device 1. In an aspect, at least a portion of the housing may be substantially transparent so that the operation of the mechanism may be observed, however such construction is not necessary.

One of the compartments, for example, the central compartment 10, or a portion thereof, may be configured so that it is also capable of translation in a direction out of the plane of the drawing, such that it is capable of protruding from the device to accept a deck of cards inserted into the compartment by a person. The central compartment 10 may be moved to accept the deck of cards 90 either mechanically by pulling on a knob, or by an automatic mechanism (not shown) in response to pushing a button, or the like, on the device. Once a deck of cards has been placed into the compartment, the compartment may be returned to an internal configuration. In the state shown in FIG. 1A, the deck of cards 90 is shown as having been placed in the central compartment 10.

Cards are moved by one or more transport mechanisms which will be later described. The deck has N cards, where N is typically 52 as is used in the games of poker, bridge, and the like, but may be any other number such as may be used in preference, pinochle, and the like. Having been placed in the central compartment 10, with the base 100 of the central compartment positioned above an upper lip 32 of the right-hand and left-hand compartments, respectively, cards are dispensed from the bottom of the deck by a transport mechanism (not shown) through a slot or aperture in the bottom of the right-hand-side surface 11 of the central compartment so as to be introduced into the right hand compartment 20. The cards are individually dispensed in this manner such that, as shown in FIG. 1B, approximately half of the cards in the deck placed in the central compartment 10 are transferred into the right-hand compartment 20. The transport mechanism associated with the central compartment 10 now begins to dispense cards from the bottom of the deck through another slot or aperture (not shown) in the bottom of a left-hand portion of the central compartment so that the remainder of the approximately half of the cards remaining in the central compartment 10 are dispensed into the left-hand compartment 30. After completion of this process, in the state shown in FIG. 1C, approximately half of the cards (N/2) are disposed in the left-hand compartment 30 and approximately half of the cards are disposed in the right-hand compartment 20, and there are no cards in the central compartment 10.

The division of the cards of the deck 90 into two portions 90*b*, one in each of the right-hand compartment and the left-hand compartments, need not be exact. That is, only approximately half of the deck of cards may be present in each of the compartments although the total number of cards is the same as the total number of cards N in the deck 90. This is consistent with the human act of cutting, or splitting a deck of cards before or after another of the activities associated with preparing a deck of cards by shuffling. The step of cutting may also be performed again at the conclusion of the shuffling process, although a final cut of the deck may often done manually as a matter of ritual in card games.

When the cutting or splitting operation is performed manually, the number of cards in each resultant stack tends to vary about an even split of the deck. Such a situation may be simulated by programming the controller of the apparatus 1 such that a number of cards in each stack varies randomly about the value of half of the size of the deck, from cut-to-cut.

In another aspect, the split may be performed by dispensing approximately half of the deck 90 from the central compartment 10 into either one of the right-hand compartment 20 or the left-hand compartment 30: a "side compartment". The height position of the central compartment 10 is then lowered with respect to at least the side compartment containing cards. The portion of the card deck that is in the side compartment is dispensed by the side compartment transport mechanism so that the portion of the deck in the one of the side compartments is returned to the central compartment 10. Thus the cards originally on the bottom of the deck in the central compartment have now been returned to the central compartment at the top of the deck.

The riffling process is that of recombining the cards of the portions 90*b* previously dispensed into the left-hand compartment 30 and the right-hand compartment 20 into a single deck of cards 90 positioned in the central compartment 10. The central compartment 10 is positioned such that a base 200 of the right hand compartment 20 and a base 300 of the left hand compartment 30 are disposed in the vertical plane such that each of the right hand base 200 and the left hand base 300 is above an upper lip 12 of the central compartment 10. This repositioning of the compartments may be performed by either lowering the central compartment 10 with respect to the right-hand compartment 20 and the left-hand compartment 30 or, alternatively, raising the right-hand compartment 20 and the left-hand compartment 30 with respect to the central compartment 10. It should be noted that it is the relative position of the compartments that characterizes the process, and which of the compartments are actually moved is a design detail.

In the state shown in FIG. 2A, the riffling process is begun by activating the transport mechanisms of the right-hand compartment 20 and the left hand compartment 30 such that cards are dispensed from the bottom of the partial deck 90*a* in the left-hand compartment 30 and the bottom of the partial deck 90*b* in the right-hand compartment 20 into the central compartment 10 through apertures (not shown) in the bottom of a side 33 and a side 23 of the left-hand compartment 30 and the right-hand compartment 20, respectively.

The transport mechanisms are operated contemporaneously. That is, the transport mechanism of the right-hand compartment 20 and the transport of the left-hand compartment 30 are activated such that cards are being dispensed from each of the right hand compartment and the left hand compartment 30 in an individual fashion and where the dispensing of cards substantially alternates between the slot of the left-hand compartment 30 and the slot of the right-hand compartment 20. In this manner the partial decks of cards 90*b* are recombined into a complete deck 90 disposed in the central compartment 10 as shown in FIG. 2B. In this state, the cards of the deck are arranged such that, approximately, a card dispensed from the right-hand compartment 20 is alternated with a card dispensed from the left-hand compartment 30. While the alternate arrangement of the dispensed cards is a generally desirable result, alternation of two cards from one of the left-hand or right hand compartment with one card from the other of the left-hand or right-hand compartment is not detrimental. Such a lack of perfect alternation may be a result obtained with manual shuffling, and so long as there is not a perceived contrived arrangement of the resultant deck of cards, the operation can be considered successful.

Another manipulation of the cards which may be introduced into the shuffling operation is stripping, which is a variation on cutting, and is shown in FIG. 3. The arrangement of the compartments is the same as for the cutting operation of FIG. 1, and the mechanical details of the arrangement will not therefore be further described. A deck of cards 90 is positioned in the central compartment 10. The transport mechanism of the central compartment 10 is operated so as to dispense a quantity of cards from the central compartment 10 into the right-hand compartment 20. Where the deck has a quantity of cards N, the number of cards dispensed is an integer number, M. After dispensing M cards into the right hand compartment 20, the transport mechanism of the central compartment then dispenses an integer number of cards M into the left hand compartment 30. Typically, the integer number of cards M may be between 2 and 10, but other values are possible. Exactly M cards may not be dispensed at each stage of the operation, and the value of M may change during the operation. This is comparable to the variability of performing this operation by a human. When M is N/2, the stripping operation degenerates into a cutting operation.

With a combination of cutting, riffling and stripping, the typical operations associated with shuffling a deck of cards for the playing of a card game may be performed by the automatic card shuffling device 1. The number of times that each operation is performed, and the sequence of the operations, may be fixed during the design of the apparatus, or an input device may be provided on the apparatus such that a user may customize the process for a particular application, such as games having less than 52 cards in a deck, or a greater or lesser number of the component actions of the shuffling process. For example, a lesser number of operations will take a shorter period of time to perform, but may not as fully randomize the distribution of cards in the shuffled deck.

Figure 4A:
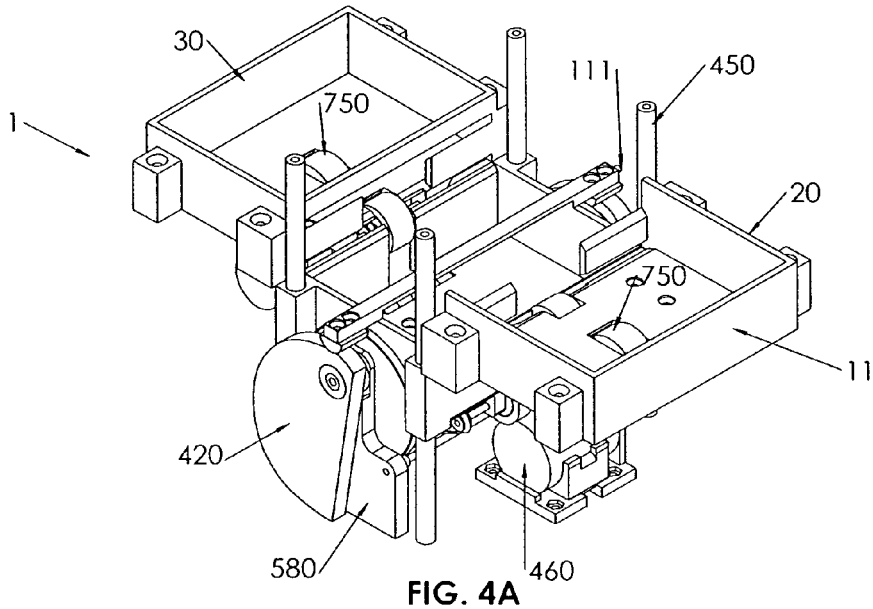
FIG. 4 is a (A) perspective view; and, (B) an exploded perspective view of an example of a card shuffling apparatus.
Figure 4B:
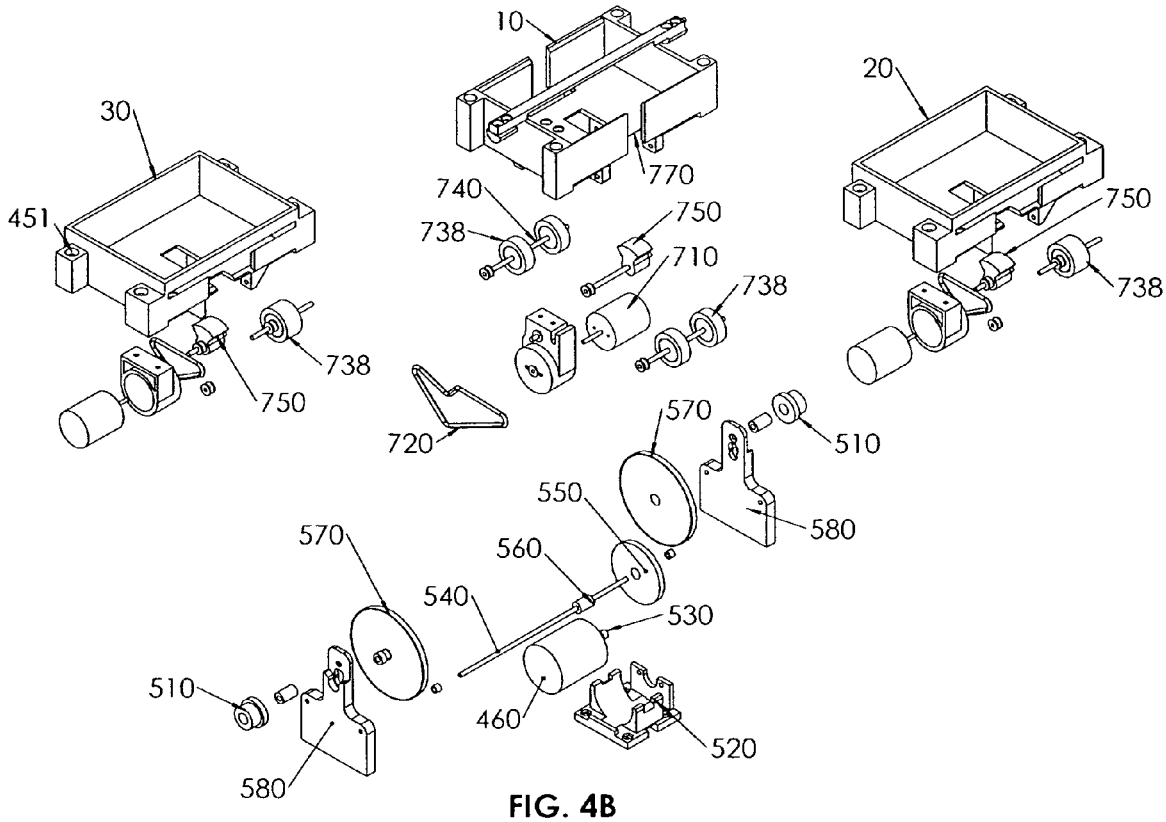

An example of an automatic card shuffling apparatus 1 is shown in FIG. 4. A perspective view of the interior mechanisms is shown in FIG. 4A and an exploded view is shown in FIG. 4B. For clarity, such components as electrical wiring, power supplies, computer boards and the like are not shown as these aspects are well known and would unduly complicate the figures. The card shuffling apparatus 1 is intended to be mounted to a support structure, which may include an exterior housing. One of the compartments, which may be the central compartment 10 is adapted to slide in a horizontal plane, in whole or in part, as later described, so as to project horizontally with respect to the state shown in FIG. 4A so as to facilitate the introduction or removal of the cards to be shuffled. A cam 420 and cam follower 111 act as an elevator or lifting mechanism to move the central compartment 10 up and down with respect to a right-hand compartment 20 and a left-hand compartment 30. In this example, the central compartment 10 is guided in the vertical direction by posts 450 threaded through engaging holes 451 in the corners of the central compartment 10.

Although not shown, a side of the housing of the apparatus may be made partially or wholly of substantially transparent or transparent material so that the operation of the apparatus can be observed by a player. And end surface of the compartments may also be made partially of wholly of substantially transparent or transparent material. Verification of operation of the shuffler may be considered either desirable or necessary by the persons using the device.

Although the description herein may explain the operation by, for example, placing the deck of cards 90 in the center compartment 10, when the center compartment 10 is in a raised position, and removing the cards from the center compartment 10, when the center compartment 10 is in a lowered position, this is only one example of a configuration which may be chosen for the design or operation of the card shuffler device 1. Access to the central compartment may be possible in a particular design in one or both of the raised or lowered positions, or be restricted by the placement of other components.

In an aspect, access may be provided to the card shuffler device 1 by at least one of the side compartments 20, 30 so that the cards may be introduced or removed from the side compartments 20, 30, either directly or using a sliding mechanism. The operational program of the shuffler may be designed to accommodate the specific compartment into which the cards are introduced or removed, for example, such that the cards are first moved by the transport mechanism from a side compartment 20, 30 to the central compartment 10 prior to the start of the shuffling process, and returned to the same or different compartment after the completion of the shuffling process.

FIG. 5 is an elevation cross-sectional view of the left-hand compartment 30, the right-hand compartment 20, and the center compartment 10. Attached to the bottom of the compartments are the left-hand transport mechanism 35, the right-hand transport mechanism 25 and the central transport mechanism 15. Each of the transport mechanisms may have a motor, an assemblage of pulleys, drive belts and other components. In addition, support posts 450 may be disposed at the four corners of the center compartment 10 such that the center compartment 10 may be slideably supported for motion in the vertical direction.

Figure 5A:
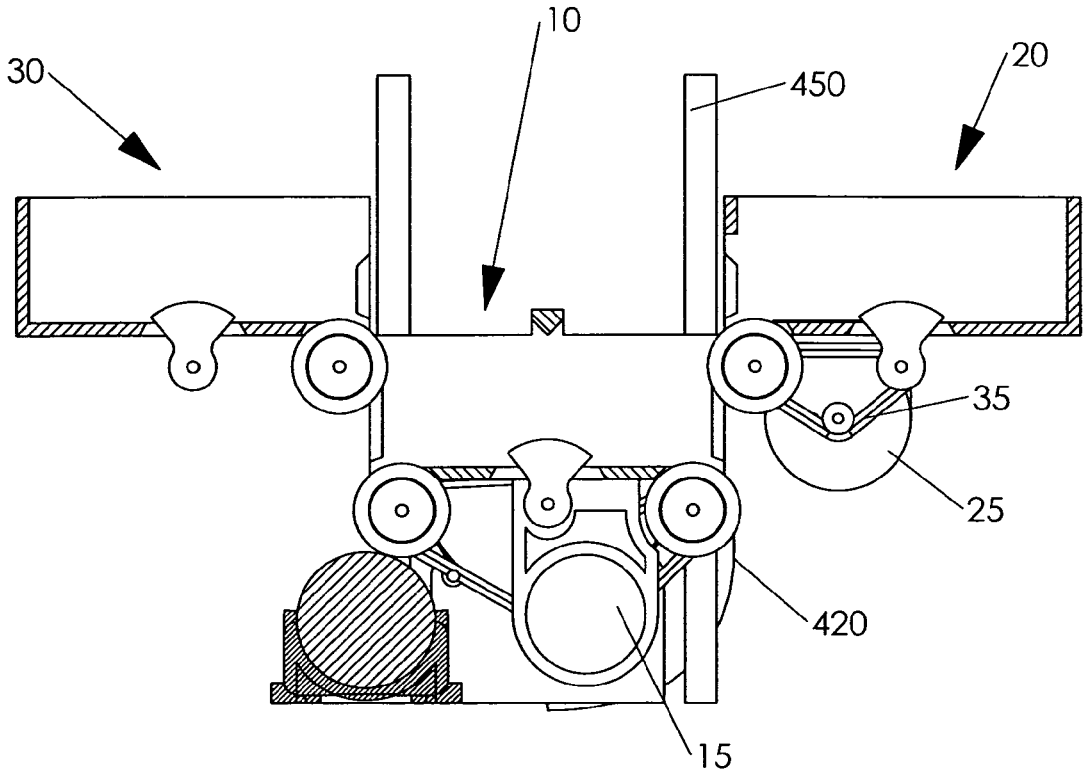
FIG. 5 shows the orientation of card compartments when performing (A) a riffle operation; and, (B) a cut, split, or stripping operation

FIG. 5A shows a state where the positions of the center compartment 10, the right-hand compartment 20 and the left-hand compartment 30 are arranged such that a riffle operation, as in FIG. 2, may be performed. Each card may be ejected or dispensed from the left-hand compartment 30 and the right-hand compartment 20 into the central compartment through a slot or aperture in a lower portion of the side wall of the left-hand and right-hand compartments.

Figure 5B:
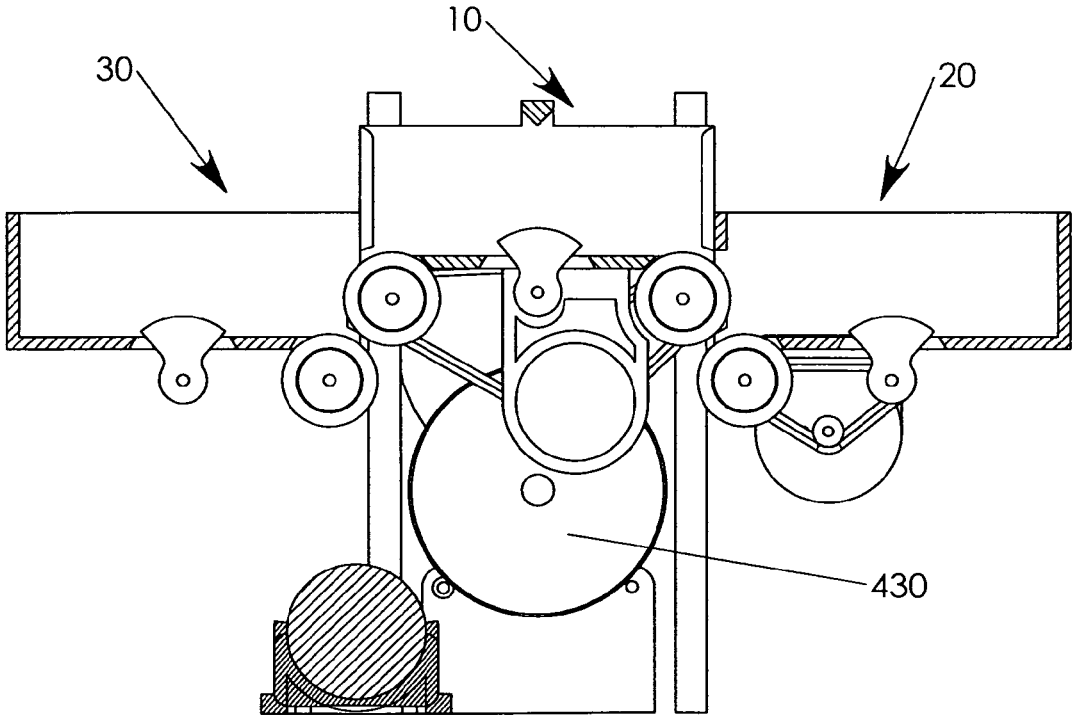

FIG. 5B shows a state where the positions of the center compartment 10, the right-hand compartment 20 and the left-hand compartment 30 are arranged such that the cutting or splitting operation of FIG. 1 may be performed. Cards are dispensed or ejected from the central compartment 10 into the right-hand compartment 20 through the slot in a lower end of the side wall of the central compartment. After a number of cards are dispensed from the central compartment 10 to the right-hand compartment 20, the transport mechanism of the central compartment 10 is operated to dispense cards through a slot in a lower side wall of the central compartment 10 into the left-hand compartment 30.

This state shown in FIG. 5B is the same as shown in FIG. 1B and may be associated with either a cutting operation or a stripping operation of FIG. 3, depending on the number of cards dispensed in sequence into one of the side compartments before cards are dispensed into the other one of the side compartments.

Although a sequence of actions where the right-hand compartment is mentioned before the left-hand compartment may be used to describe an portion of the process, a person of ordinary skill in the art will appreciate that the terms left-hand and right-hand compartment are used for convenience in description, and the description is intended to encompass an interchange of the sequence of operations of the left-hand and the right-hand compartments, and of the order in which the central compartment dispenses cards into the side compartments.

Figure 6A:
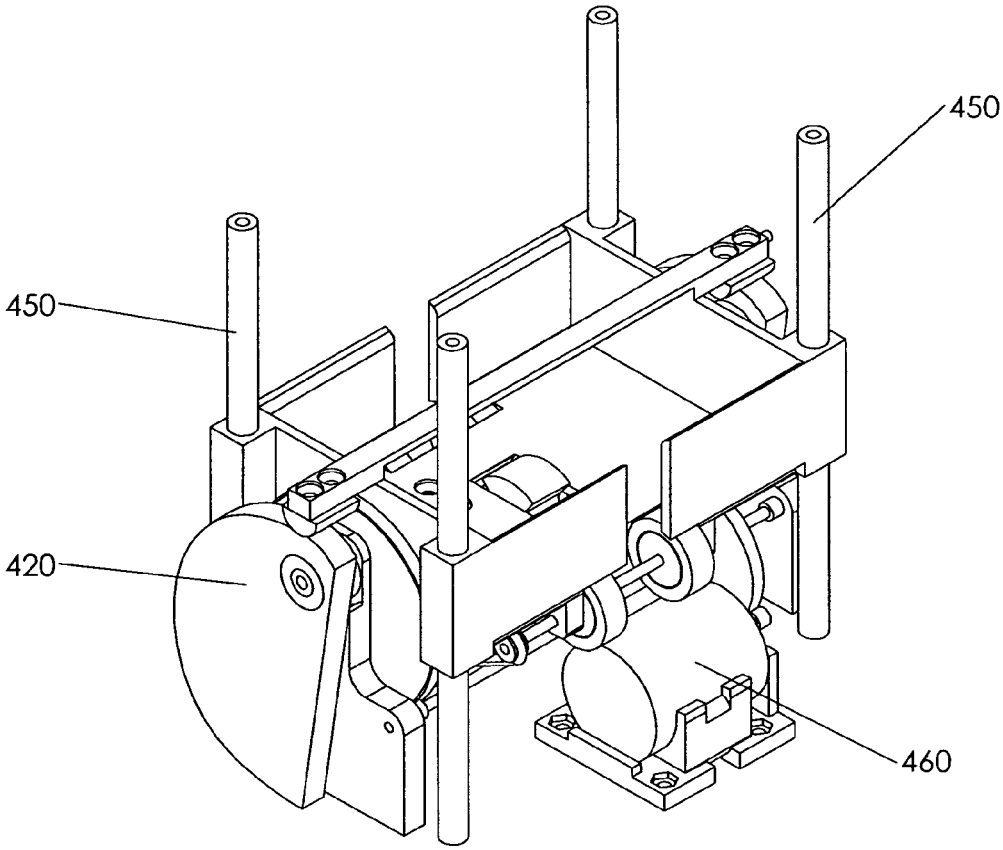
FIG. 6 is a detail view showing the central card compartment and an associated elevator mechanism in (A) a lowered position; and, (B) a raised position.
Figure 6A:
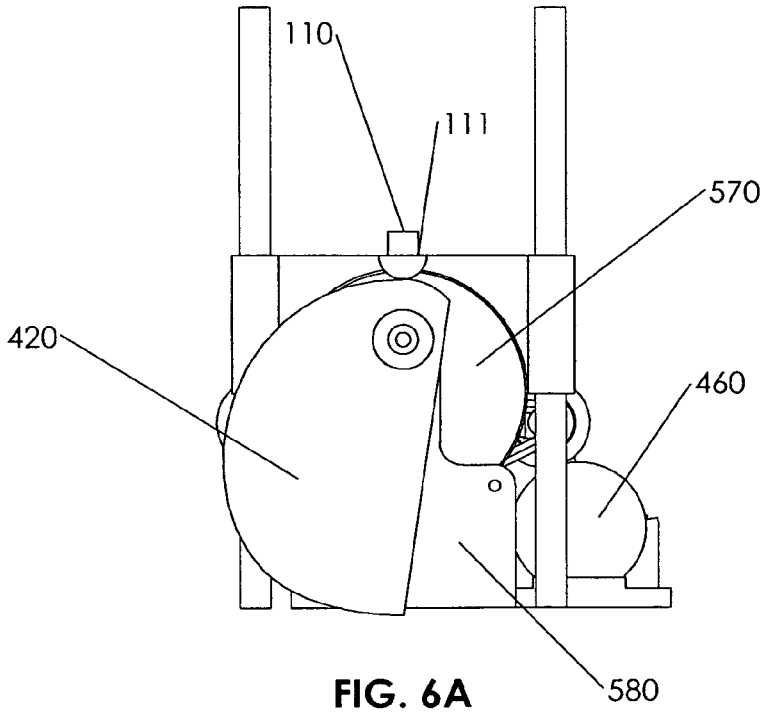

The central compartment 10 may be raised or lowered with respect to the left-hand compartment 30 and the right-hand compartment 20 by an elevator mechanism, an example of which is shown in FIG. 6. A cam and cam follower mechanism actuated by a rotary motor is shown, however any means of raising and lowering the central compartment 10 may be used, including for example, crank mechanisms, a crank with a connecting rod, and scissors jacks, a rack and pinion or the like. The selection of elevator mechanisms may depend on the interior design of the automatic card shuffling device, the weight of the deck(s) of cards, cost, and other engineering considerations.

In another aspect, the vertical position of the central compartment 10 may remain fixed and one or more of the side compartments may be raised and lowered with respect thereto.

Figure 6B:
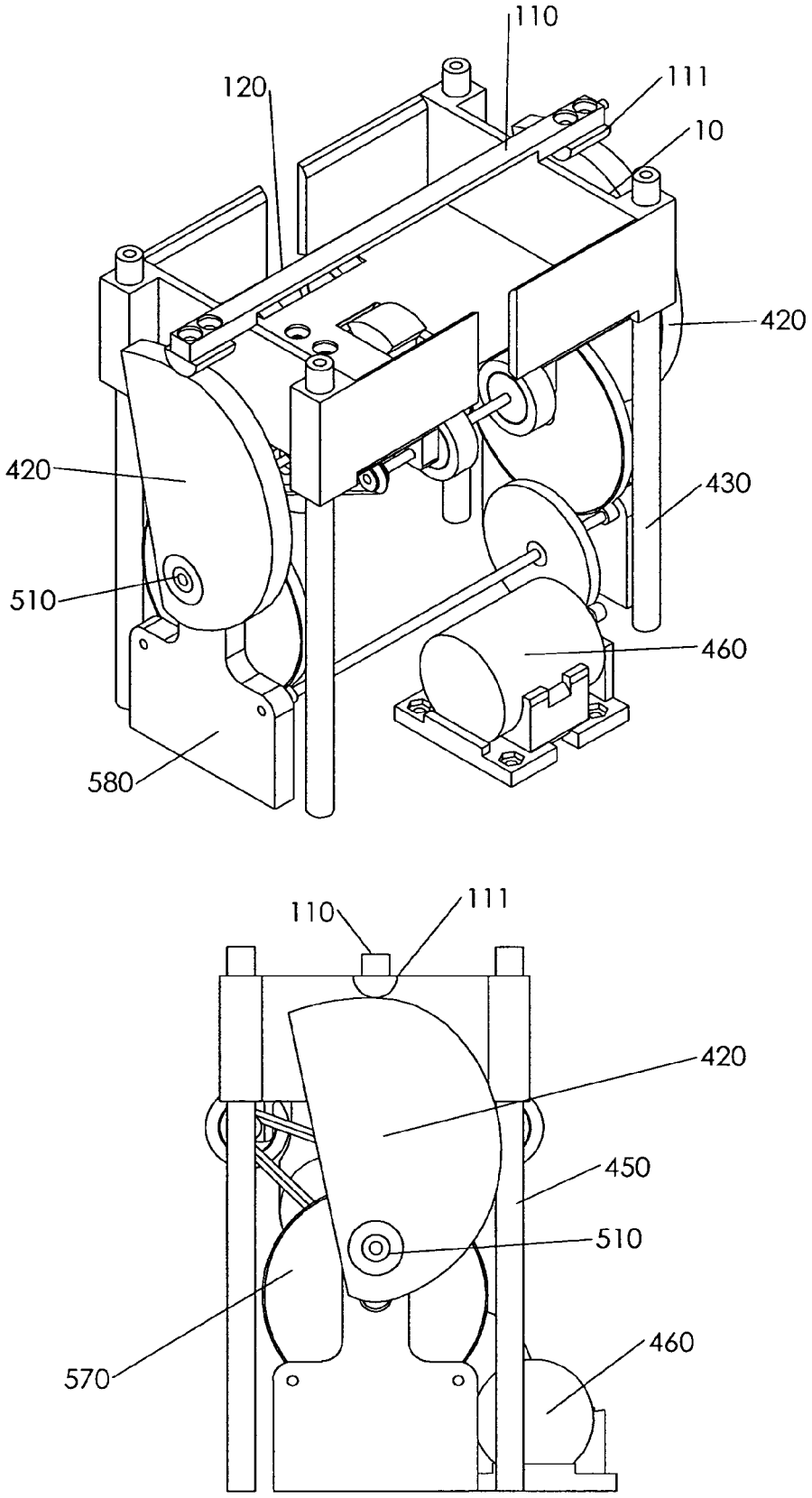

An example of an elevator mechanism is shown in FIG. 6, where a cam and cam follower are used to change the vertical position of the central compartment 10. The central compartment 10 may be guidably restrained by vertical posts 450, by slide grooves (not shown) in the external housing, or the like. In this example, apertures are provided in the four corners of the central compartment 10, and sized to slidably receive the vertical posts 450, so that the central compartment may move in a vertical direction. The central compartment has a deflector bar 110, which may have an extension that functions as a cam follower 111. A cam 420 is fixed to an axle rotatable by a motor 460. The weight of the central compartment 10 may maintain the cam follower 111 in contact with a surface of the cam 420. Maintaining this contact may be assisted by springs (not shown) placed over the vertical posts 450 and bearing on the upper supports of the vertical posts 450, or a similar configuration, so as to exert a downward pressure on the central compartment 10 when the central compartment 10 is in a uppermost position (such as shown in FIG. 6B). FIG. 6A shows the central compartment 10 in a lowered position and the cam follower 111 is closer to the axis upon which the cam 420 rotates than the situation which obtains when the central compartment 10 is in the uppermost position (as shown in FIG. 6B).

The deflector bar 110 may be omitted or, alternatively, also provided in the side compartments. A resilient member may be projected from the deflector bar 110, or other surface of a compartment, or a surface of the enclosure, so as to deflect or guide the cards being introduced into a compartment so that the cards are accumulated in a stack oriented substantially flat with respect to a bottom surface of the compartment.

A second cam 420 and cam follower 111 may be provided on an opposing side of the central compartment 10 so that the forces applied in the lifting process are symmetrically distributed.

Figure 7:
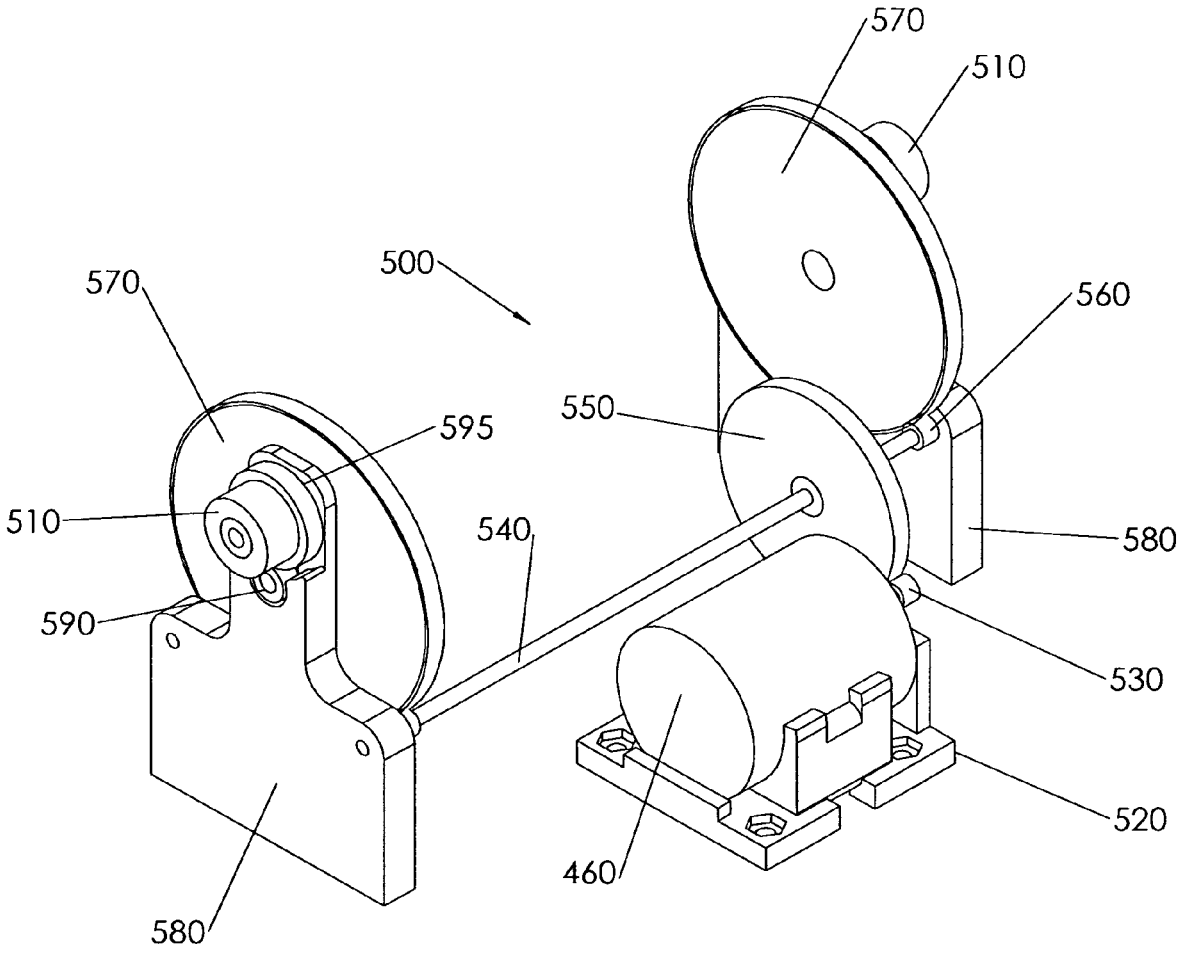
FIG. 7 shows a detail view of part of the drive mechanism for a cam-type elevator mechanism.

As may be seen in FIG. 6B and in more detail in FIG. 7, the cam 420 is rotatably moved by a gear train 500 coupled to the motor 460. The cam 420 is fixably attached to an end of shaft stub 510, mounted to a bushing (not shown) in an end plate 580 of the elevator mechanism. The shaft stub 510 is rotated by the motor 460, the motor 460 being fixably attached to the assembly body (not shown) by a mounting bracket 520. A motor shaft is terminated by a pinion gear 530, engaging a bull gear 550. The bull gear 550 is fixedly attached to a shaft 540 extending between bushings on opposing end plates 580. Also attached at either end of the shaft 540 are second pinion gears 560, engaging second bull gears 570. The second bull gears 570 are mounted to the end plates 580 by a shaft having a third pinion gear 590 on an opposing side of the end plate 580, so as to rotatably captivate the second bull gear 570 to end plate 580. The third pinion gear 590 engages a geared portion 595 of the shaft stub 510. When the motor 460 rotates, the gear train causes the cam to rotate about the shaft stub 510 as an axis. The cam follower 111, in contact with the cam 420, raises or lowers the central compartment 10, depending on the direction of rotation of the motor 460.

The details of the gear train are a matter of engineering choice depending on the mechanical advantage desired, the overall layout of the assembly, and the like.

Figure 8A:
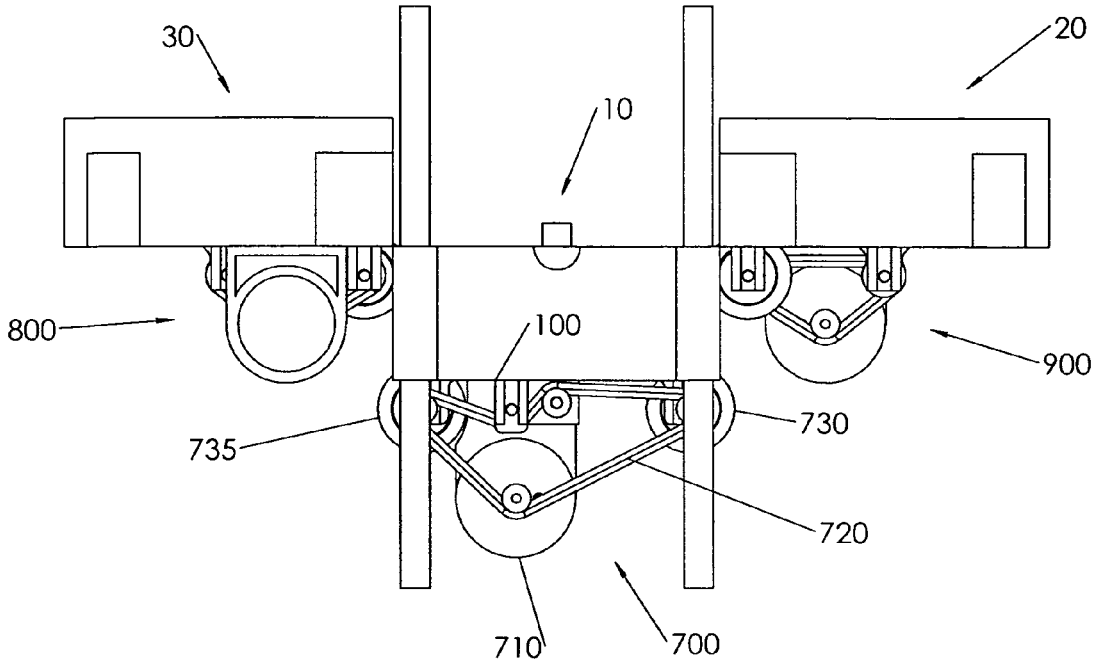
FIG. 8 shows a detail view of the card transport mechanisms: (A) the left-hand, right-hand and central compartments disposed for riffling, and (B) the central compartment in a perspective view.
Figure 8B:
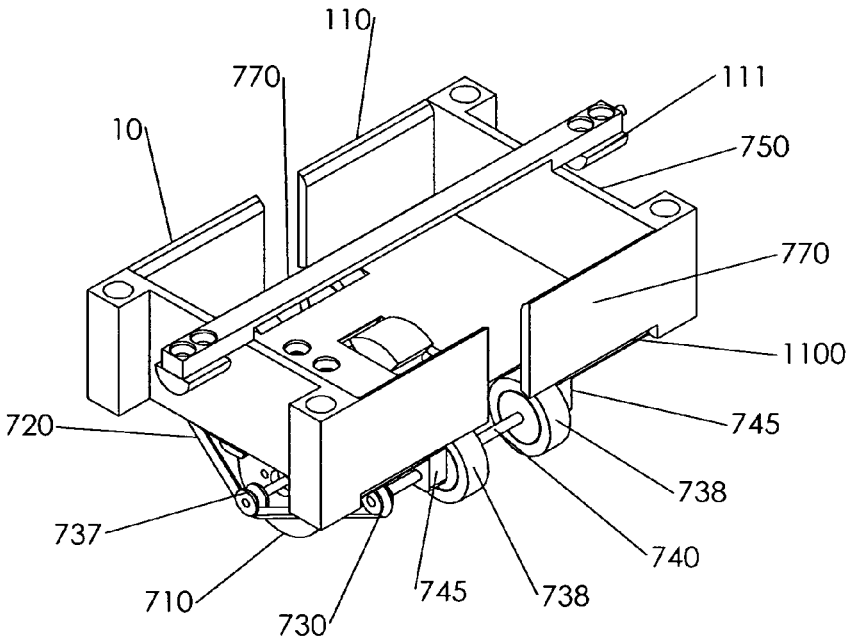

As shown in FIG. 8, a left-hand compartment transport mechanism 800, a central compartment transport mechanism 700 and a right-hand compartment transport mechanism 900 may be provided for dispensing cards from each of the compartments to another of the compartments. The central compartment transport mechanism 700 may be configured so as to be capable of dispensing cards into the left-hand compartment 30 or the right-hand compartment 20. The left-hand compartment transport mechanism 800 is capable of dispensing cards from the left-hand compartment 30 to the central compartment 10, and the right-hand compartment transport mechanism 900 is capable of dispensing cards from the right-hand compartment 20 to the central compartment 10.

As shown in FIG. 8, the central compartment transport mechanism 700 is mounted beneath the lower surface 100 of the central compartment. A motor 710 is mounted to the underside of the lower surface 100 and drives a belt 720 engaging with fixed pulleys 730 and 735 disposed near opposing sides of the central compartment 10 and pulley 737 on the motor shaft. Right-hand pulley 730 is mounted at an end of shaft 740 which is supported with respect to the lower surface 100 by mountings 745, having a bushing. Two rollers 738 are attached to the shaft 740 such that they rotate with the shaft 740. The rollers 738 are sized such that they project through the lower surface 100. An opening 772 is provided in the lower surface 100 so that the rollers 738 may contact the bottom card of the deck of cards, or portion thereof that may be in the central compartment 10. Another pulley and roller 750 are disposed in an opening in the central region of the lower surface 100.

When the motor 710 is actuated and rotates in a clockwise direction as viewed from the front in FIG. 8, pulley 730 also rotates in a clockwise direction and similarly drives the rollers 738. The pulley driving the central roller 750 is arranged such that the central roller 750 also rotates in a clockwise direction. The lowermost card of a deck of cards, resting on the central roller 750 and the right-hand rollers 738 will be urged towards the right-hand compartment 20 through a slot 1100 in the lower right-hand side of the central compartment 10. Rollers are also present on the left-hand side of the central compartment 10 and may rotate in the same direction as the rollers previously described. The left-hand rollers may contribute to the initial urging force for transporting the card from the central compartment 10 to the right-hand compartment 20.

When the motor 710 is actuated and rotates in a counterclockwise direction, the direction of rotation of the rollers 738 and 750 is reversed, and the lowermost card of the deck of cards will be urged towards the left-hand compartment 30 through a slot in the lower left-hand side of the central compartment 10. Thus, by controlling the direction of rotation of the motor 710, the cards may be dispensed or ejected into one or the other of the side compartments. The number of cards dispensed may be determined by the time duration of operation of the motor, the number of revolutions of the rollers, or by a sensor determining the number of cards dispensed through a slot or received by a compartment. The exhaustion of the stack of cards in a compartment may also be used to sense completion of a portion of the process.

The completion of this aspect of the process may be determined by any one or more of: time duration of the dispensing operation; the number of rotations of a roller; a sensor in the compartment from which the cards are ejected; a sensor in the compartment receiving the cards, or the like. Whenever a card transfer operation is described, the means of determining completion of a step or a portion of a step being described may be determined by one or more of the sensing or timing operations. The sensing operation may be by any one of optical or mechanical means such as a photodetector, feeler gauge or the like, and the control of the device actions may be by means of a mechanical linkage, or a microprocessor having a memory and executing stored computer readable instructions.

The rollers 750, 738 may be smooth, roughened, or have sticky properties. In addition, the roller 750, which may be termed a "kicker" may have a surface where a segment of the circumference is recessed with respect to a maximum diameter of the roller. In this aspect, the roller 750 may contact the card for only a portion of the rotation of the roller. The kicker may operate to lift the deck of cards so that a plane of the lower card is angled towards the slot or aperture. When the roller 750 is extended to approximately a maximum height above the bottom surface of the compartment, the lower card may be positioned with respect to the aperture so as facilitate the passage of the card through the aperture. This may result in approximately a maximum projection of a portion the aperture orthogonal to the plane of the card being dispensed or ejected through the aperture. When used in this manner, the roller may assist in maintaining a flow of individually dispensed cards. The aperture may be sized and dimensioned so that a card lying approximately flat with respect to the bottom of the compartment may not pass through the aperture.

Each of the side compartments has a similar transport mechanism to that of the central compartment 10. The side compartment transport mechanisms 800, 900 may have a central roller 750 and rollers 738 disposed at the side of the compartment adjacent to the slot leading into the central compartment through the lower side wall of the side compartment. As cards in either of the side compartment are dispensed into the central compartment 10 from either the left-hand compartment 30 or the right-hand compartment 20, the motor associated with the transport mechanism is rotated either clockwise or counterclockwise as appropriate.

Figure 9A:
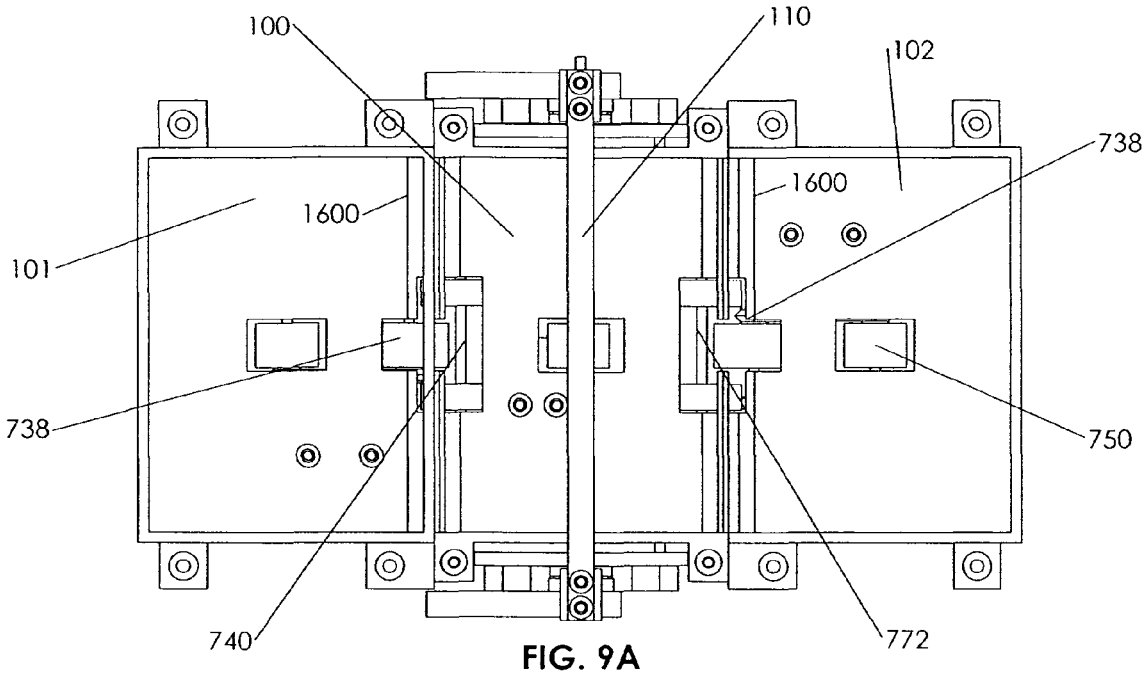
FIG. 9 shows (A) a top view of FIG. 8A; and, (B) a side view of FIG. 8A including the cam-type elevator.

The side compartment rollers 738 are illustrated in FIG. 9A, where it may be seen that adjacent rollers 738 may be provided in each side compartment, protruding through a slot 740 in the lower surfaces 101 and 102 of the side compartments. The spacing between the rollers in the side compartments is such that the rollers are disposed between the rollers 738 at either side of the central compartment 10. This is one of many configurations of rollers which may be used. The side compartment rollers 738 may be combined into a single roller, or the arrangement of the side compartment rollers and the central compartment rollers interchanged. A slotted opening 770 may be provided in the side walls of the central compartment 10 so as to provide clearance for the rollers 738 of the side compartments when the central compartment is raised or lowered with respect to the side compartments by the elevator mechanism.

A continuous belt 720 has been shown, but other belt arrangements such as a toothed belt engaging with toothed pulleys or a gear train may also be used. More than one motor may be used to actuate a transport mechanism, and the various pulleys may be sized such that the rotation rate of the rollers may differ.

The weight of a card or cards in the compartment may be sufficient to provide a contact force between the card and the roller 738 or the kicker roller 750 so that the card may be transported in the desired direction in response to the rotation of the motor.

In operation, the central compartment 10 containing a deck of cards 90 and associated transport mechanism 700 may raised by the elevator mechanism so that the dispensing slots 1100 in the central compartment 10 are positioned opposing a top opening in each of the left-hand 20 and the right-hand 30 compartments. The transport mechanism 700 may be operated with the motor turning in a clockwise direction so as to eject cards through the dispensing slot 1100 towards the top opening in the right-hand compartment 20. When a desired quantity of cards has been dispensed in this manner, the rotation sense of the motor may be changed to a counterclockwise direction so that cards may be dispensed through the dispensing slot 1100 from the central compartment 10 into the top opening of the left-hand compartment 30. This dispensing operation is continued until a desired number of cards had been ejected. When stripping cards, these operations may be repetitively performed multiple times. When cutting or splitting a deck, approximately half of the cards are dispensed in the first step and the remainder of the cards are dispensed in the second step. The second step may be run for a time longer than the time duration of the first step, if the step is a timed step, so as to ensure the exhaustion of cards from the central compartment 10.

Once the deck of cards 90 has been cut or stripped, the central compartment 10 is positioned such that the open top of the central compartment 10 permits cards ejected through the dispensing slot 1600 of the left-hand compartment 30 and the right-hand compartment 20 to be merged into a single deck of cards 90 using the riffling process previously described.

Figure 9B:
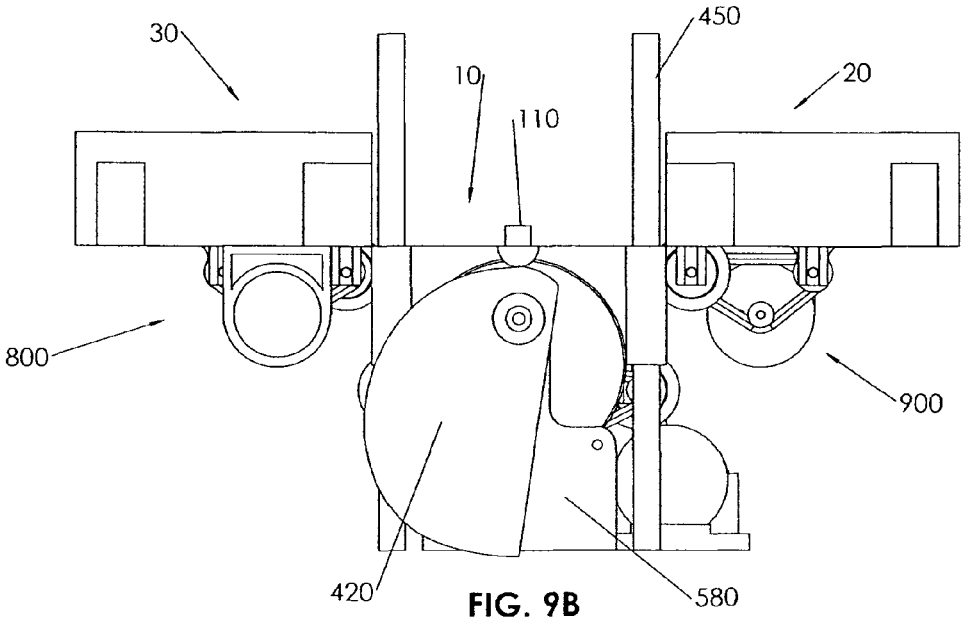

The riffling operation is performed by positioning the central compartment 10 so that a top open portion thereof is disposed approximately opposite a dispensing slot 1600 in each of the side compartments (FIG. 9). The card transport mechanisms 800, 900 in the left-hand compartment 20 and the right-hand compartment 30 may be actuated such that both of the card transport mechanisms are active for a substantially simultaneous or simultaneous period of time. The card transport mechanisms eject or dispense cards through the slot 1600 of each of the left-hand compartment 30 and the right-hand compartment 20 into the open top of the central compartment 10. The ejected cards may contact the card deflector 110 so as to be guided into the central compartment 10, although this may not be necessary. The dispensing slot 1600 is dimensioned such that, typically, a single card is dispensed for each full rotation of the shaft to which the kicker roller 750 is attached. The result of this process is a merging of card portions 90*a* and 90*b* into a single stack of cards 90 (not shown) in the central compartment 10 by approximately interleaving individual cards from each of the card portions 90*a* and 90*b*.

The operation of shuffling, including riffling, cutting, and perhaps stripping, may be repeated for a predetermined number of times, typically a total of 6 or 7. The total number of times that the operation is repeated is believed to have an optimum number of 7; however this may be adjusted in accordance with user preferences or requirements, and may be either more or less than 7. A counter display (not shown) may indicate the total number of times the deck of cards 90 has been shuffled.

When the deck of cards 90 has been shuffled for the predetermined number of times, the shuffling operation is considered to have been completed. At the conclusion of the shuffling operation, a compartment may be positioned so that the cards can be removed by a user. This may be accomplished by positioning the central compartment 10 so that an end side thereof is opposite an aperture in the side of the apparatus and a portion of the central compartment 10 may be translated so that it projects from the apparatus 1. Alternatively, the central compartment may be further raised so that the central compartment 10 projects above a top surface of the apparatus 1. The latter arrangement may be useful for flush mounting of the apparatus with a table top. In an aspect, a side compartment may be positioned so that it protrudes from the apparatus or the housing in a state where a deck of cards is being placed in or removed from the apparatus.

The device may automatically translate the central compartment 10 out from the side of the apparatus 1 so that the cards may be removed or may remain in the end of operations state until the user takes some action, such as pushing a control button, to cause the drawer to extend from the device or by mechanically pulling the drawer out. Once the deck of cards 90 has been removed from the compartment, the apparatus 1 is ready to accept another deck of cards.

Each of the compartments has at least one slot 1100, 1600, for dispensing cards, and may have an aperture for receiving cards. FIG. 10 is a cross sectional view showing an example where an aperture for dispensing cards 1100 is provided in a side 11 of the central compartment 10. The aperture for receiving cards is the open top of the central compartment 10, having a deflector bar 110. In another aspect, the top of the central compartment may be closed, and a receiving slot disposed in the upper side portion thereof, which may be disposed opposite a dispensing slot in at bottom side surface of a side compartment.

Figure 10A:
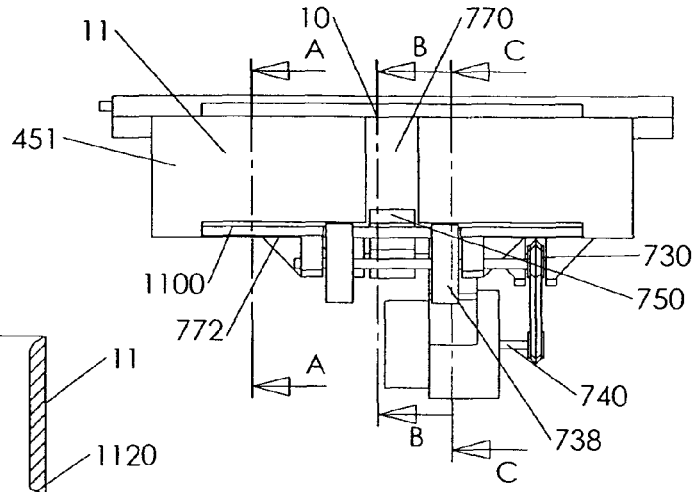
FIG. 10 shows cross sectional views of the central compartment: (A) longitudinal view; (B) a transverse view at the kicker portion of the transport mechanism; (C) a transverse view at a section without transport mechanism components; and, (D) a transverse view at a side-roller-portion of the transport mechanism.

FIG. 10A is an elevation view of a side of the central compartment 10 as viewed from one of the side compartments. A slot 770 is provided in the side 11 extending from the bottom surface 100 to the top of the side 11 so as to provide a clearance for the rollers 738 (not shown) on the side compartments. Rollers 738 of the central compartment are disposed so as to extend through slot 772 into the central compartment 10. The rollers 738 are mounted on shaft 740 so as to have a common shaft with pulley 730. Roller 750 is disposed substantially at the midpoint between opposing side walls 11 of the central compartment 10. Holes 451 are provided in the corner portions of the central compartment 10 so as to engage with vertical supports 450 (not shown). A slot 1100 is disposed near the bottom of the side walls 11, and extends part of the distance between the end walls of the central compartment 10, the length of the slot 1100 being sufficient to accommodate the length of a playing card. A minimum cross section of the slot 1100 is at least greater than the thickness of a playing card, and may be shaped to facilitate the dispensing of a playing card through the slot 1100. The slot may be angled so that the card may have to be lifted by the kicker in order to pass through the minimum cross-section region. The slot 1600 in the side compartments has similar characteristics to the slot 1100 in the central compartment 10.

Figure 10B:
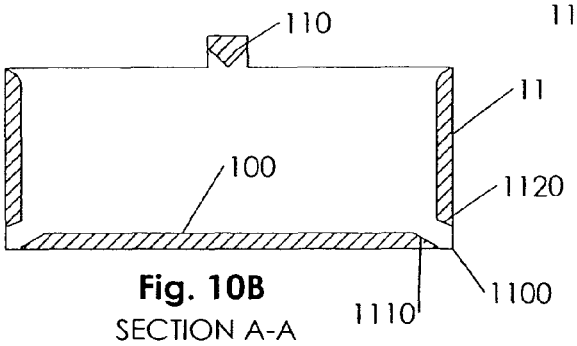
Figure 10C:
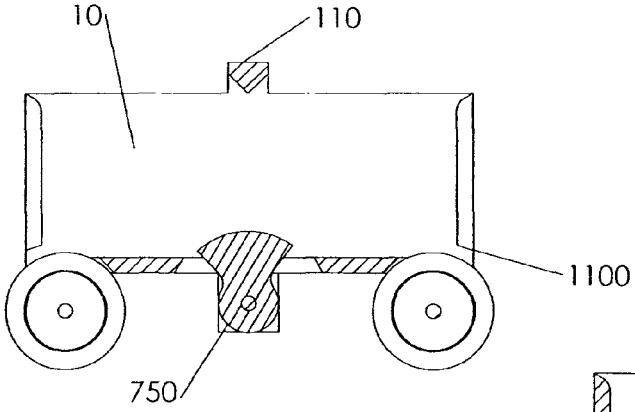
Figure 10D:
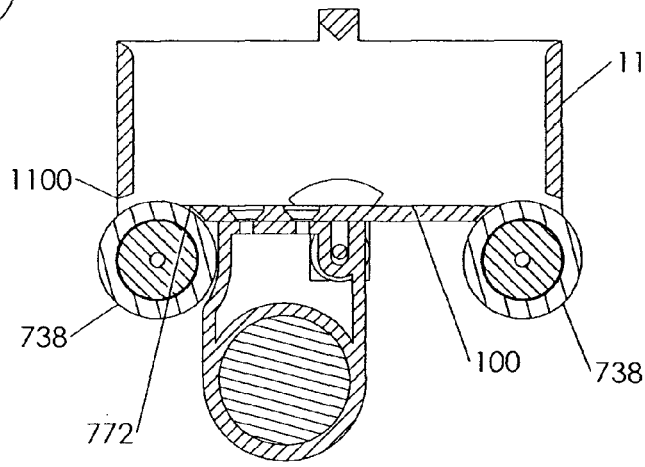

FIGS. 10B-D illustrate simplified cross-sectional views of the central compartment 10. FIG. 10B is a cross section view at B-B through the central kicker roller 750. The cross-section of the kicker roller 750 is such that the diameter of a portion of the circumference thereof is less than a maximum diameter thereof. The maximum diameter thereof is sufficient to bring a circumferential surface of the kicker roller 750 in contact with a card laying on the lower surface 100, however the smaller diameter is such that there is no contact between the kicker roller 750 and the card. Therefore, the kicker roller 750 may be in contact with the card for only part of the rotation period of the kicker roller.

FIG. 10C illustrates cross-section A-A where the slot 1100 is at the base of the side wall 11 and may have an aperture formed between a upper surface 1120 associated with the side wall 11 and a lower surface 1110, associated with the lower surface 100 of the central compartment 10. The upper 1110 and lower surfaces 1120 of the slot 1100 may be inclined so as to guide the card in a downwards direction as the card is dispensed through the slot 1100, and to have a dimension between the upper surface 1110 and the lower surface 1120 that is greater than a single card thickness, while having a dimension that tends to result in cards being dispensed substantially one at a time. The slot may be angled downward, and may be sized and dimensioned so that a single card passes through the aperture when the card is urged from an angled position by the kicker. Thus, only a single card may be dispensed for each revolution of the kicker. The edges of the surfaces 1110 and 1120 may be rounded at the entrance or exit of the slot 1100.

FIG. 10D illustrates cross-section C-C through one of the rollers 738 and shows the opening 772 permitting the roller 738 to project through the bottom 100 of the central compartment 10 so as to be capable of contacting a card laying on the upper surface of the bottom portion 100.

The side compartments are similar in construction to that of the center compartment, however a roller may not be provided on the side of the side compartment distal from the central compartment 10, and the equivalent of a slot 770 may be provided should a clearance aperture be needed between the rollers 738 of the side compartment and a side 11 of the central compartment 10. The side compartments may be sized so as to receive half of the deck 90 as the cutting, splitting or stripping processes transfer only half of the cards in the deck from the central compartment to any one of the side compartments, providing that the side compartment so sized is not one through which a full deck of cards is introduced to, or removed from, the apparatus.

A variety of elevator mechanisms are known to those of skill in the art, and would be selected depending on the size of the overall apparatus and the placement of other components within the apparatus, the weight to be moved, or other engineering considerations.

Figure 11A:
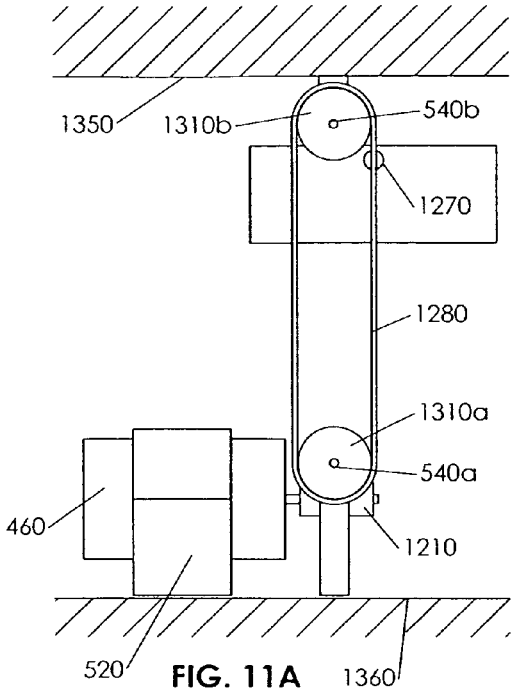
FIG. 11 is (A) an end view; (B) a side elevation view; and (C) a perspective view of a belt driven elevator mechanism.
Figure 11B:
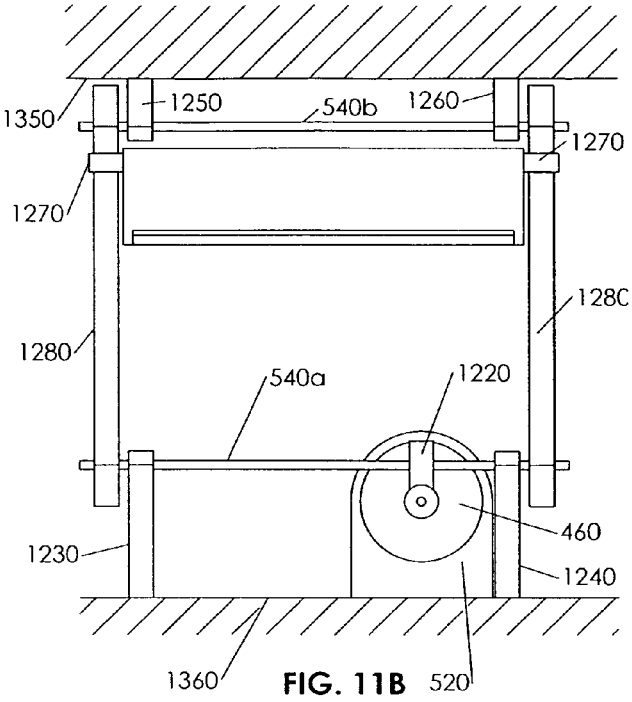
Figure 11C:
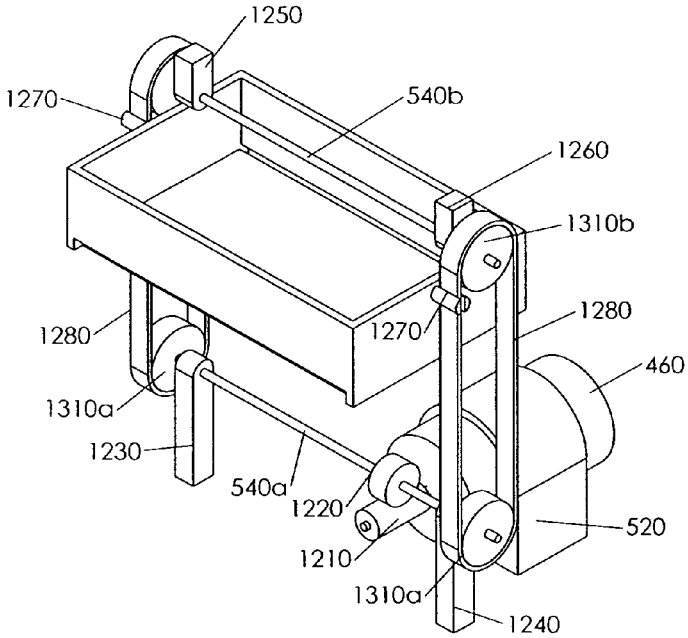

In an aspect, the elevator mechanism may be as shown in FIG. 11A-C. Here, the sliding support posts 450 and the captivation holes 451 are not shown, for clarity. The symmetrical belt drive mechanism of this example has fewer gears and components than that shown in, for example FIG. 4, but serves an equivalent purpose. Only the central compartment 10 of the three card compartments is shown. A supporting structure is shown conceptually by surfaces 1350 and 1360, which may represent the housing of the card shuffler apparatus 1, or other fixed support so that the support posts 1230, 1250, 1260, 1270 are maintained in a fixed relationship to each other.

A motor 460 is mounted to the lower support surface 1360 by a mounting 520 and has a worm 1210 extending from one end thereof. The worm 1210 engages a worm gear 1220 that is fixedly attached to a lower axle 540*a*. In this manner the rotational motion of the motor is transferred to a rotational motion of the lower axle 540. The selection of the gearing of the worm 1210 and worm gear 1220 is selected, for example, based on torque and speed requirements. The axle 540*a* passes through bushings in lower supports 1230 and 1240 so as to permit a pulley 1310*a* to be fixedly attached thereto at one or both ends. Alternatively, the pulley may be affixed to the axle prior to the shaft engaging the bushing.

Where the term "fixedly" attached or joined is used, the components being thus described are attached, affixed or joined together in a temporary or permanent manner so that they maintain a fixed relationship to each other in an operational state. Any known fastening technique may be used, depending on manufacturing or servicing considerations, to include gluing, heat sealing, screwing, the use of springs or interlocking portions, riveting, swaging, and the like. Motion in one or more axes other than the axes described as fixed may be permitted during operation An upper axle 540*b* is disposed so as to pass through bushings in upper supports 1250 and 1260, the supports being fixedly attached to an upper support surface 1350. Pulleys 1310*b* may be fixedly mounted to ends of the axle 540*b* protruding from the bushings in the upper supports 1250 and 1260. A continuous belt 1280 is positioned so as to engage with lower pulleys 1310*a* and upper pulleys 1310*b*, such that a rotation of the lower pulleys 1310*a* results in a rotation of the upper pulleys 1310*b* and the upper axle 540*b*.

The central compartment 10 has a engaging fitting 1270, disposed so as to fixedly engage with a belt 1280, and as the belt 1280 moves in accordance with the rotation of the lower pulley 1310*a*, the central compartment 10 is moved up or down in depending on the sense of rotation of the lower pulley 1310*a*.

In an aspect, the belt 1280 may be a toothed belt, with the teeth engaging with corresponding gear teeth on the pulley 1310*a*. Pulley 1310*b* may have teeth, or may be smooth, and the pulleys may have lips (not shown) at the periphery thereof to prevent the belt from sliding off. The pulleys may be fabricated with a sticky surface for contacting the belt in place of the teeth, or the contact between the belt and the pulleys maintained by frictional forces.

Figure 12A:
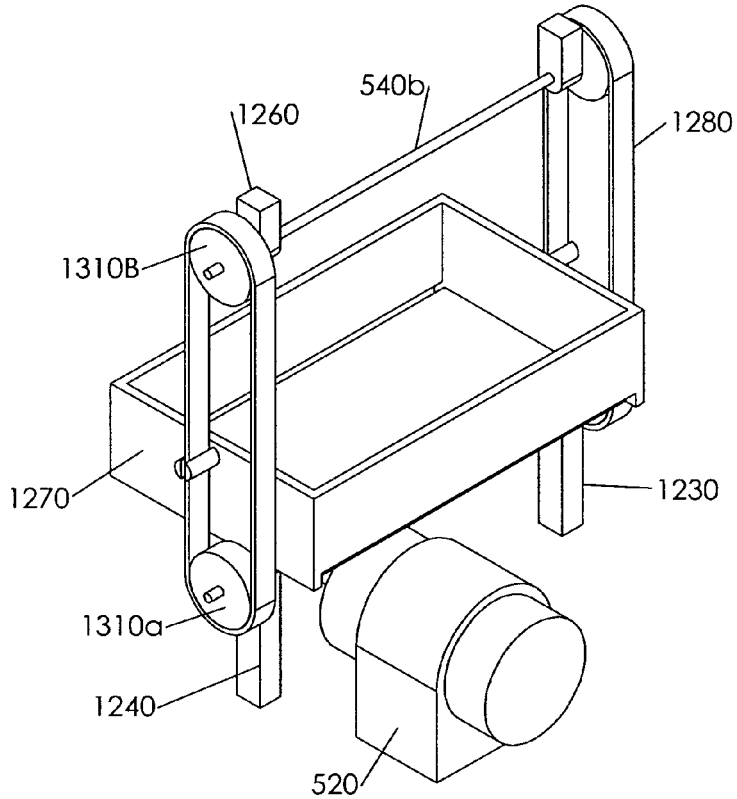
FIG. 12 is (A) a lowered position and (B) is a raised position of the central compartment in a perspective view of a belt driven elevator mechanism.
Figure 12B:
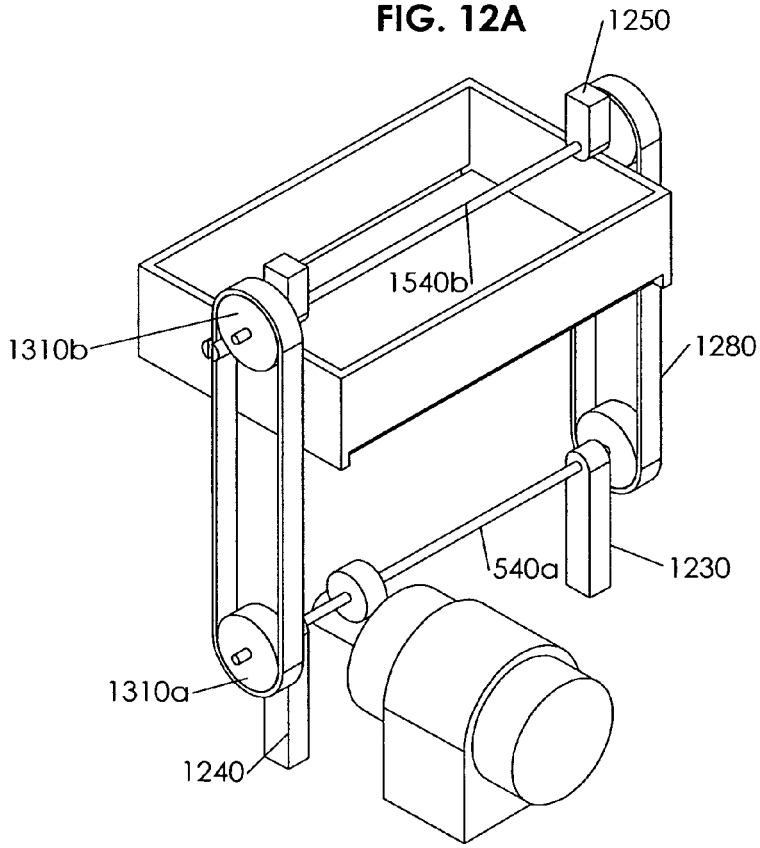

FIG. 11 illustrates the mechanism with the central compartment 10 in a raised position, and FIG. 12A-B is a perspective view showing the central compartment 10 in a lowered (A) and a raised (B) position.

Figure 13:
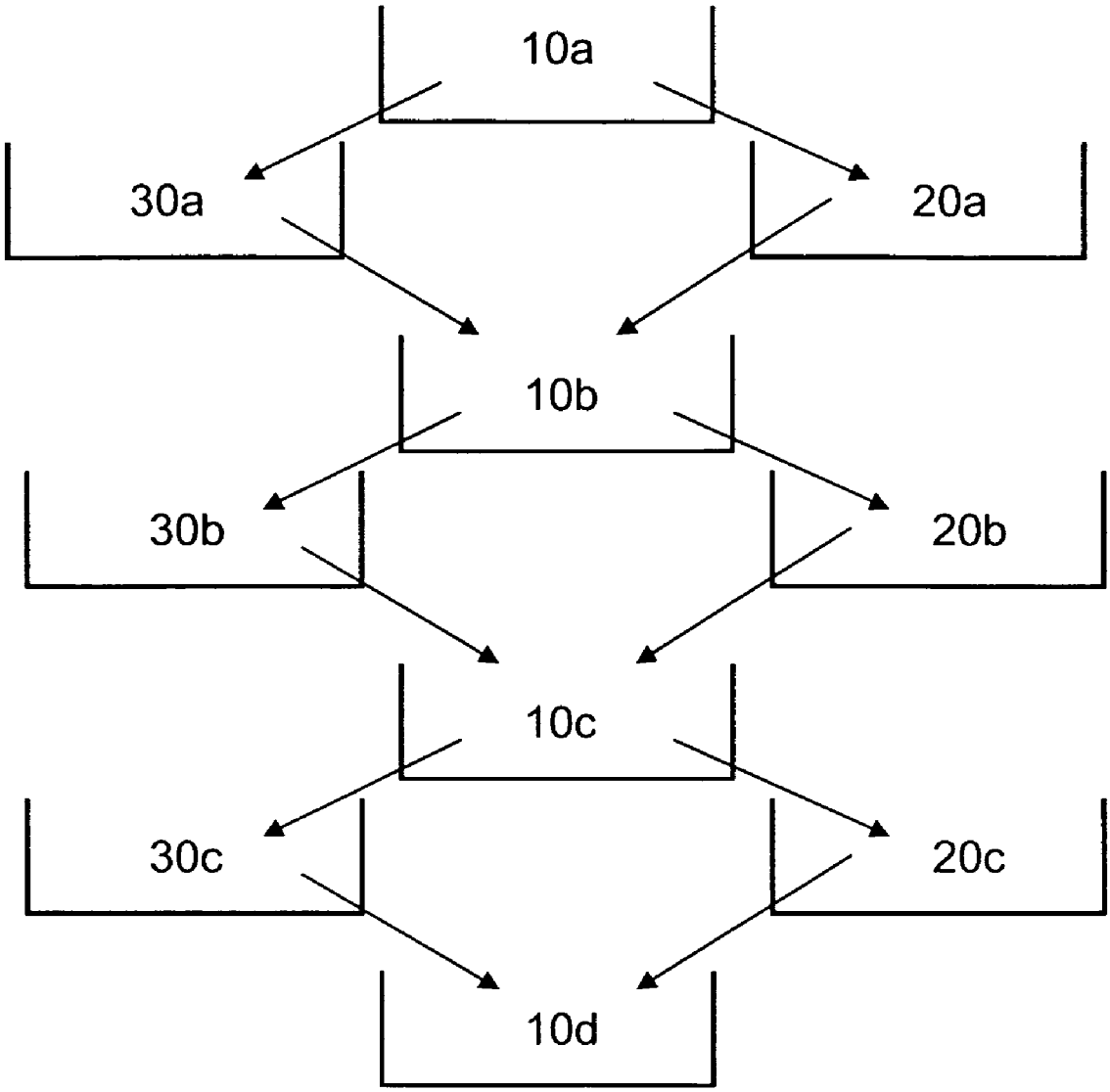
FIG. 13 is a conceptual view of another example where the compartments have a fixed physical relationship.

In another example, the automatic card shuffler apparatus may be configured without an elevator mechanism. FIG. 13 shows a schematic representation of such an apparatus. The same types of card transport mechanisms may be used as described for the first example and the transport mechanisms will not be further described. Similarly the card dispensing slots and other features may be similar, except that there is no elevator mechanism, and clearance slots such as 770 in the previous example may not be needed.

A plurality of center compartments 10 are arranged such that they are vertically interleaved with side compartments 20, 30. Each of the center compartments 10*a*-10*d*, except for the lowermost compartment 10*d* have a card transport mechanism similar to the card transport mechanism 700 of the first example. The topmost center compartment 10*a* receives a deck of cards 90 and the card transport mechanism 700 of the center compartment 10*a* is operated to dispense the cards into side compartments 20*a* and 30*a*. Next, the card transport mechanisms 900 and 800 of the side compartments 20*a* and 30*a* are operated to riffle the cards into the next lower central compartment 10*b*. Once this is completed, the card transport mechanism of compartment 10*b* is operated to dispense cards into side compartments 20*b* and 30*b*, in either a cut or riffle operation. Subsequently, the card transport mechanisms 900 and 800 of the side compartments 20*b* and 30*b* are operated to riffle the cards into the central compartment 10*c*. The cards in central compartment 10*c* are transferred to side compartments 20*c* and 30*c* and subsequently recombined into a full deck in the central compartment 10*d*, which may also act to dispense the card deck 90 to the user. The device may have more or fewer compartments in the vertical stack of compartments depending on the sophistication of the shuffle desired and the manufacturing cost.

The arrangement of this example may result in a taller physical structure than that of the first example, but the arrangement may shuffle the cards somewhat faster than the first example, as it may not have the step of displacing the side and central compartments vertically relative to each other. Should more riffling steps be desired, the cards may be manually transferred from the bottom compartment to the top compartment and the shuffling process repeated.

In another aspect, the operation of the various transport mechanisms may be scheduled contemporaneously so as to further reduce the time to complete a shuffle and the height of the apparatus. For example, after the cards begin to be transferred from the first center compartment 10*a* into the first side compartments 20*a* and 30*a* by the transport mechanism 700 of the central compartment 10, and some cards have accumulated in the first side compartments 20*a* and 30*a*, the transport mechanisms 800 and 900 thereof may be actuated to begin to move the cards from the first side compartments 20*a* and 30*a* into the second central compartment 10*b*. After some cards have accumulated in the second central compartment 10*b*, the transport mechanism 700 associated with the second central compartment 10*b* may be actuated such that the cards begin to be transferred from the second central compartment 10*b* into the second side compartments 20*b* and 30*b*. The operation of the transport mechanism 700 may be such that the motor operates in a clockwise direction for a period of time such as associated with a stripping operation and then rotates in a counterclockwise direction so that groups of cards are alternately deposited in the side compartments. This operation may be continued until the cards are finally deposited in the lowermost central compartment 10*d*. This may significantly shorten the overall time to shuffle a deck of cards by subsuming some of the cutting, stripping, and riffling steps. The height of the central compartments 10*b* and 10*c*, and the side compartments 20*a*-20*c* and 30*a*-30*c* may also be reduced as the compartments may not contain more than a portion of the card deck 90 at any one time.

This procedure may be more analogous to performing a stripping operation; however, at lest one of the operations may be configured to perform a cut or spilt. For performing a split, the side compartment is sized to hold at least half of the deck, whereas the stripping side compartments may be smaller as cards are being ejected from the side compartment to the central compartment during at least part of the filling process.

The operation of the transport mechanisms 800 and 900 may be such that, alternately, the left-hand compartment and the right-hand compartment is the first compartment to begin to return cards the central compartment, and the choice of the left-hand or right-hand compartment to begin this process may be such that the side compartment being filled last is the first to begin to empty the cards into the next central compartment. Other sequences of operation are also possible.

Motors and pulleys may be disposed to the side of the compartments or at the ends thereof in order to accommodate the smaller height of the compartments and a motor may be used to operate more than one transport mechanism.

Figure 14:
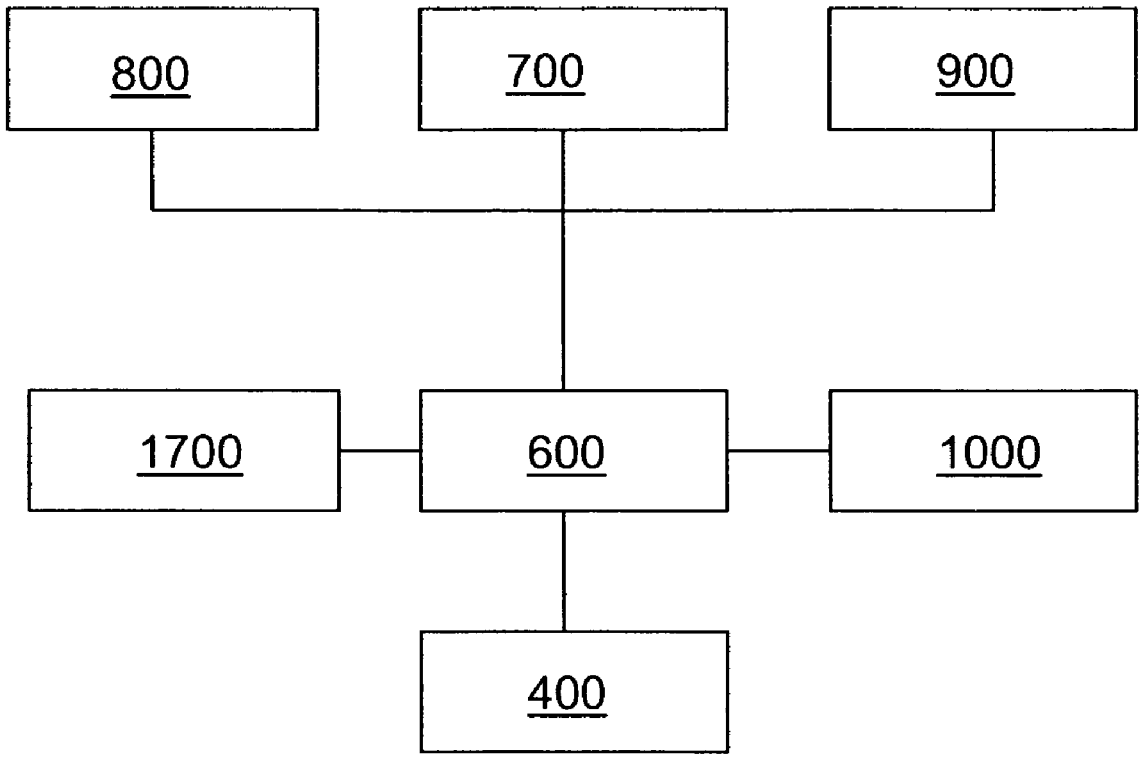
FIG. 14 is a block diagram of the first example showing control functions.

FIG. 14 is a block diagram of the card shuffling apparatus 1 showing the various functions which may be controlled by a computational component such as a microprocessor executing a stored program or machine readable instructions. The instructions for implementing processes of the apparatus may be provided on computer-readable storage media or memories which may have permanent and non-permanent storage capability, such as a cache, buffer, RAM, flash, removable media, hard drive or other computer readable storage media, which now exist or may later be developed. The functions, acts or tasks illustrated in the figures or described herein may executed in response to one or more sets of instructions stored in or on computer readable storage media. The functions, acts or tasks are independent of the particular type of instruction set, storage media, processor or processing strategy and may be performed by software, hardware, integrated circuits, firmware, micro code and the like, operating alone or in combination.

FIG. 14 illustrates an example of a control and operation of the device 1 by use of a microprocessor 600. A control panel 1000, which may be a button or buttons or other input device to initiate a process and provide input to the microprocessor 600 as to the desired operations, and a display 1700 may indicate progress or status. A display may not be provided as the state of the process may be observed visually, particularly when a part of the device is made of transparent material, or by using an indicator light. The left-hand and right-hand compartments 20, 30 each may have a transport mechanism 900, 800; the central compartment 10 may have an elevator mechanism 400 and a transport mechanism 700, and one or more card level or presence sensors. The elevator mechanism 400 may be a component which serves to change the vertical disposition of the central compartment with respect to the side compartments. Alternatively, the central compartment may be fixed in vertical position, and right-hand and left-hand compartments may be changed in vertical position. The central compartment 10 may also include a manual or automatic mechanism to extend the cards outwards from a side or from the top for used access. Alternatively, one of the side compartments may be adapted to dispense the cards to a user.

Figure 15A:
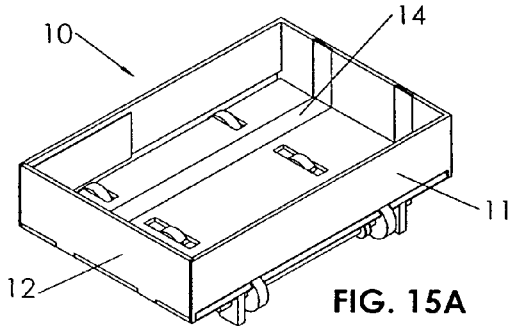
FIG. 15 shows three examples of a card access mechanism: (A) manual; (B) spring actuated; and, (C) rack and pinion.
Figure 15B:
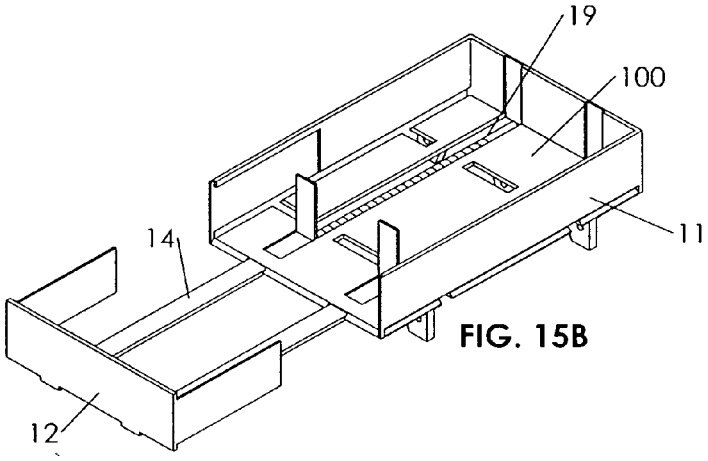
Figure 15C:
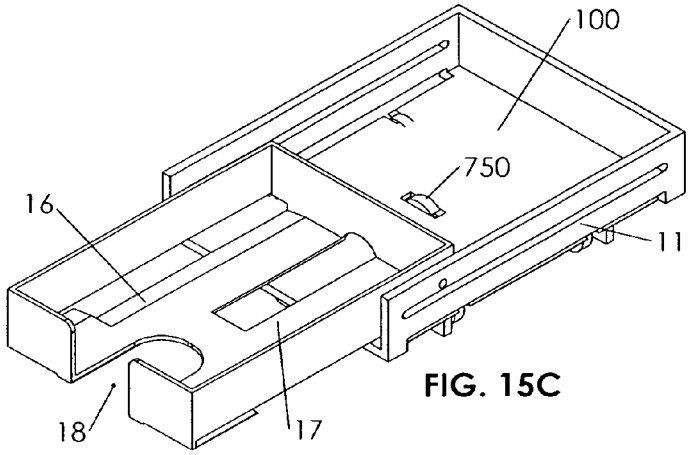

FIG. 15 illustrates a detail of a compartment, which may be the central compartment 10, and which may provide for convenient access to the central compartment 10 for the purpose of introducing a deck of cards 90 into the automatic card shuffling apparatus 1. FIG. 15A illustrates a manually operated access mechanism. One end 12 of the central compartment 10 is fabricated such that it is not joined the sides 11 of the central compartment, but is slidably secured to the bottom surface 100 of the central compartment 10. Pulling on the end 12 causes the end to slidably move outward, guided and restrained by slides 14 engaging with the bottom 100 of the central compartment. FIG. 15B shows the situation where the end has been slid outward so that the deck cards may be accessed. In the arrangement of FIG. 15B, the slides 14 and end 12 have been urged outward by a spring 19, which is compressed when the end 12 is in the closed position. Any of a number of known latch mechanisms may be used to restrain the end 12 in a closed position. Another example of a card accessing mechanism is shown in FIG. 15C, where the tray has a bottom insert 16 having a rack gear disposed on the underside thereof. The rack gear engages with a motor-driven pinion gear (not shown) and the motor may be operated to extend or retract the bottom insert 16.

Figure 16B:
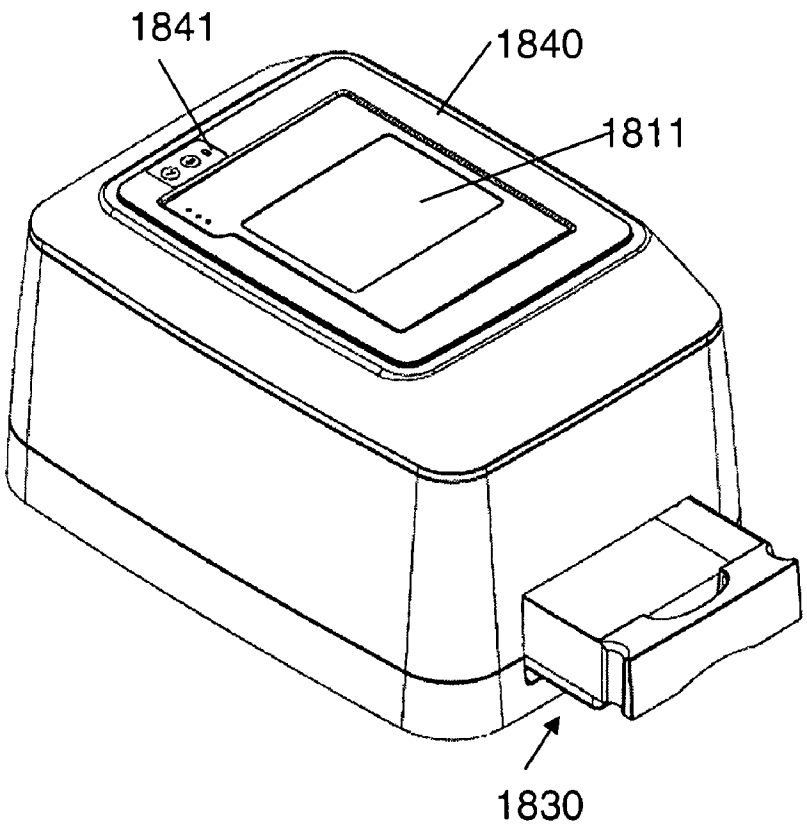
FIG. 16 is a perspective view of a card shuffling device: (A) with the top cover opened showing the central compartment; (B) with the top cover closed, showing a distribution tray partially removed from the housing; and (C) showing the distribution tray removed from the housing.
Figure 16A:
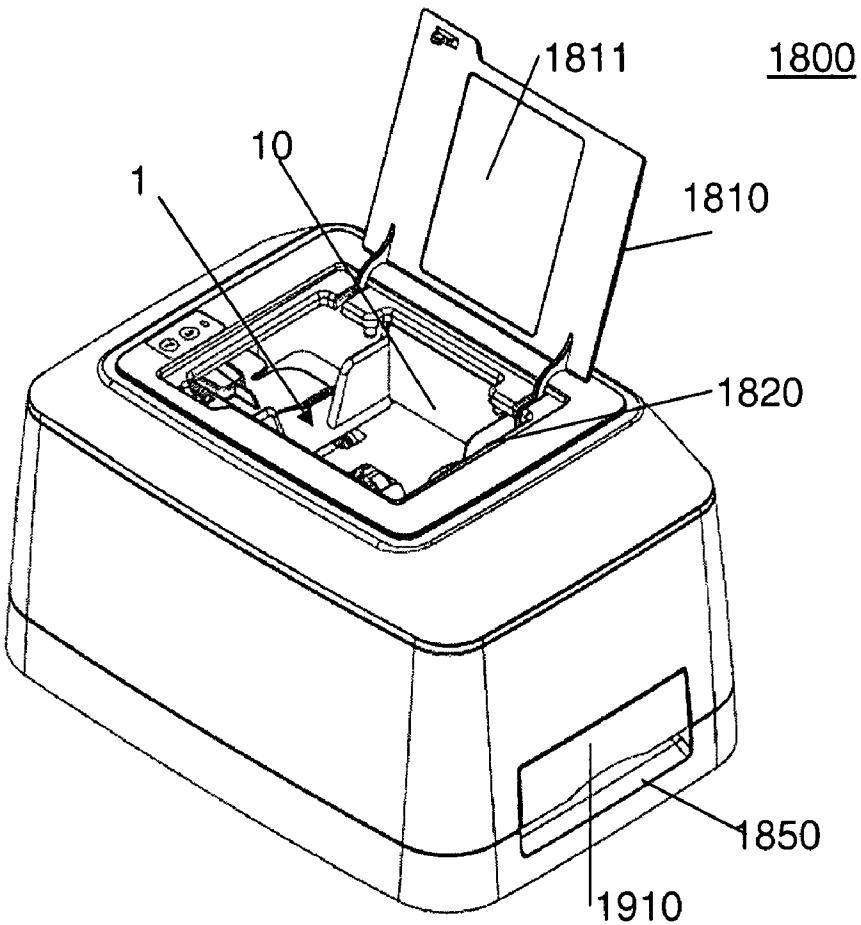
Figure 16C:
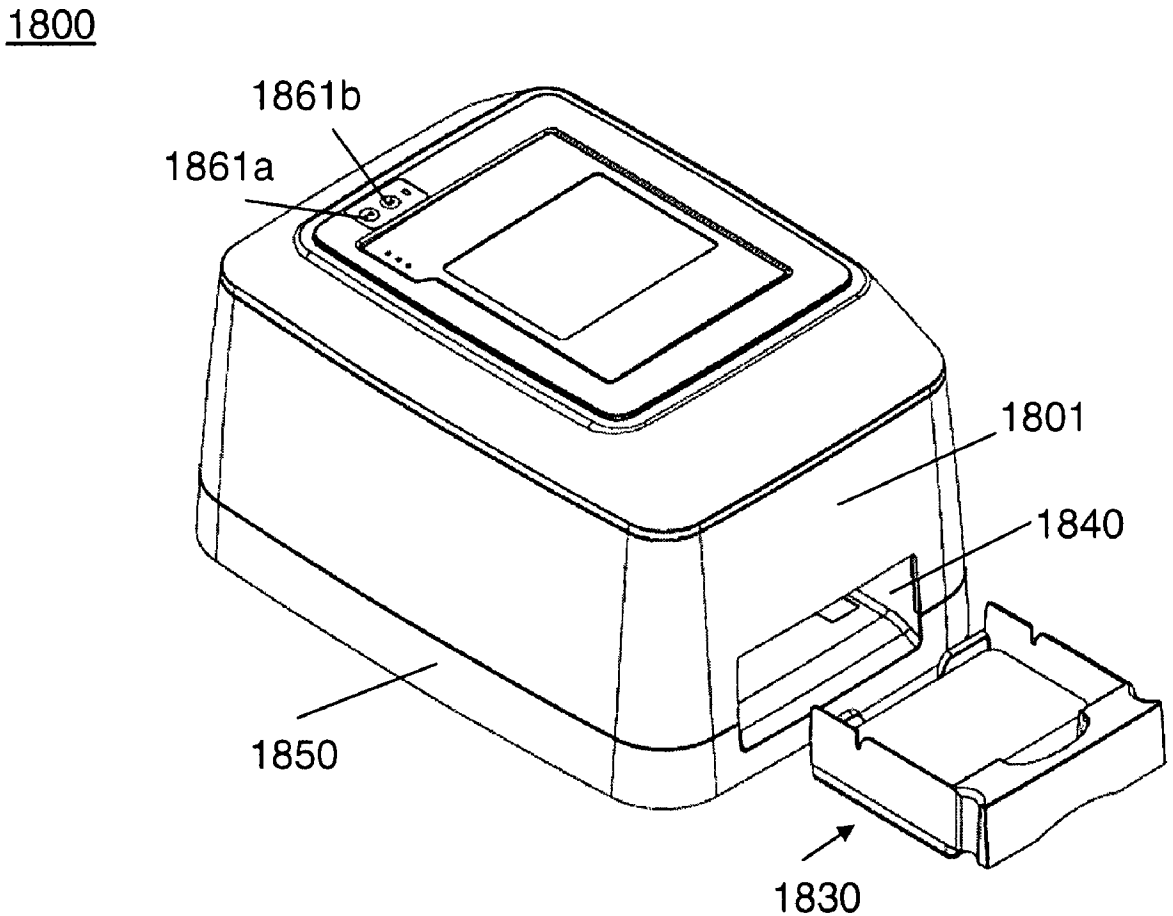

In another example, FIG. 16A shows an external perspective view of a housing 1800 for a card shuffling apparatus 1, where a top cover 1810 is in an open position such that a deck of cards (not shown) may be placed in a top compartment 10. The top compartment 10 is in an upper position, suitable for receiving the deck of cards, when the card shuffling apparatus 1 is in a state where a deck of cards can be inserted. The top cover 1810 may be transparent or have a transparent portion disposed so that an observer may determine whether the top compartment 10 is disposed so as to be capable of receiving a deck of cards, or whether a deck of cards is already present in the top compartment 10.

Cards may be inserted or retrieved from the top compartment 10, depending on a configuration of the shuffler, which may be set by a switch. The switch (not shown) may be placed on any accessible external surface of the housing 1800, including the underside thereof. The switch may configure the shuffling apparatus such that, at the end of the shuffling process, in a first state the cards are in the central compartment 10 and the central compartment is in an uppermost position so that the shuffled deck of cards may be removed by the user through the aperture 1820 formed when the lid 1810 is in an open position; and, in a second state, the cards may be dispensed into a receptacle 1830 which may be slidably positioned in an aperture 1840 in a side of the housing 1800.

The first operation state of the shuffling apparatus may be used, for example when the housing 1800 is mounted to a table, so that a top surface 1840 of the housing 1800 is substantially flush with the top of the table (not shown). Such mounting may be accomplished by mounting the housing 1800 so as to engage with adapter plate (not shown) where the engagement is nearer to the top of the housing 1800 than to the bottom thereof, and positionable so as to support the housing in an aperture in the table top surface. Alternatively, the aperture in the table top may be specifically sized and dimensioned to receive the housing 1800 and to provide support to the card shuffler. A decorative surround (not shown) may be used to blend the shuffling apparatus esthetically with the table top or other surface. In this mounting configuration, a deck of cards may be inserted into the shuffler apparatus, and removed therefrom through the aperture 1820. That a deck of cards has been shuffled, and is ready to be removed may be signified, for example, by one of an indicator light 1841, or by causing the lid 1810 to be positioned in an open or partially open position. The first state of the shuffler apparatus may also be used when the card shuffler is placed on the top of a table.

In the second operation state of the shuffler apparatus, the deck of cards may be dispensed into a receptacle or tray 1830 disposed at a side of the housing 1800 and insertable in aperture 1840. FIG. 16B illustrates the receptacle 1830 (without cards present therein) partially removed from the housing 1800. In an aspect, the receptacle 1830 may be removable from the housing so that a deck of cards present therein may be passed to the dealer of a hand of cards, while the cards remain in the receptacle 1830. Alternatively, the receptacle 1830 may be captivated to the housing 1800 so that the receptacle 1830 may be pulled out sufficiently that the deck of cards may be removed therefrom. The second operation state may be used when the shuffling apparatus is placed on a table top or other surface where the receptacle 1830 is accessible.

FIG. 15 shows several examples of the use of one of the compartments 10, 20, 30 as the receptacle. In an alternative, the receptacle 1830 may be a separate compartment that serves to receive the deck of cards after the shuffling process has been completed.

Figure 1A:
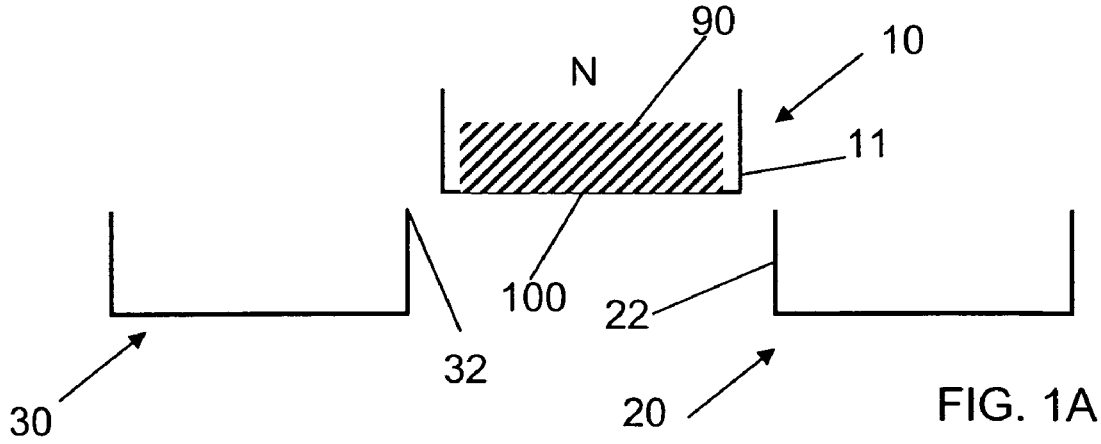
FIG. 1A-C is a conceptual diagram showing a cut or split operation on a deck of cards.
Figure 1B:
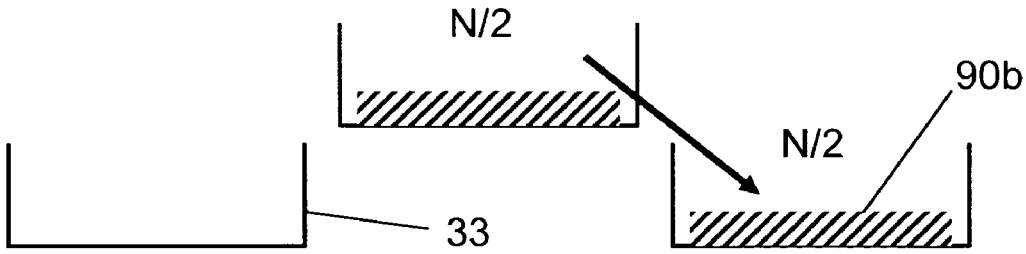
Figure 1C:
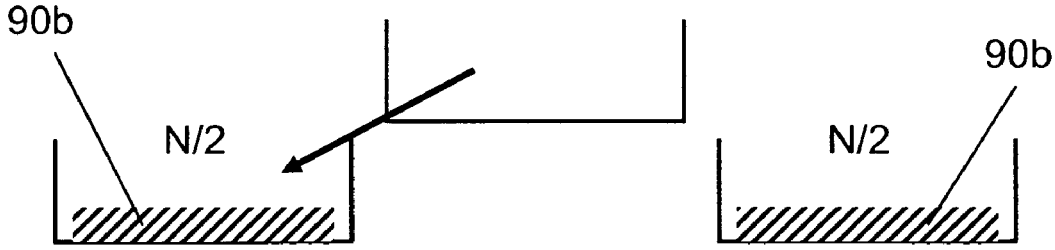

The shuffling process may be as shown, for example, in FIGS. 1-3 and which has previously been described. The spatial relationship of the compartments 10, 20, and 30 at the start of, and conclusion of, the shuffling process depends on the operation state selected by actuating the configuration switch. In the first operation state, the central compartment 10 may be first positioned in the upper position as shown in FIG. 1A so as to be able to receive the deck of cards. The shuffling process proceeds as previously described, until completed as shown in FIG. 2B, where the central compartment 10 is in disposed a lower position than that of the side compartments 20, 30. A step of raising the central compartment 10 so as to return to the upper position as shown in FIG. 1A completes the process, and the shuffled cards are in a position to be accessed and removed through the top aperture 1840.

Figure 17A:
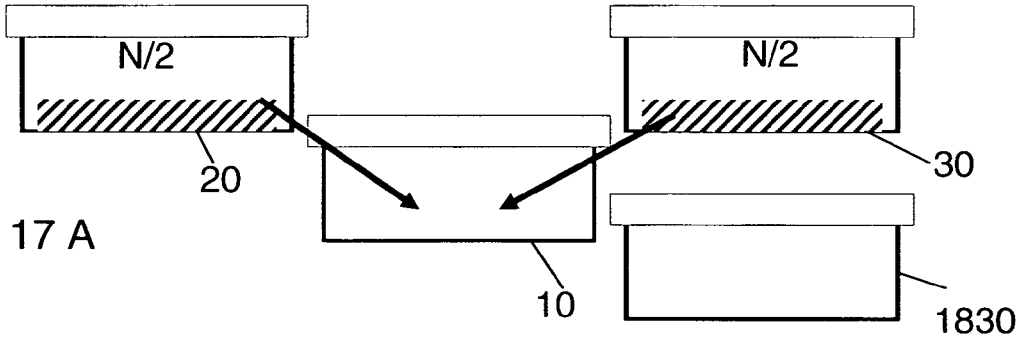
FIG. 17A-B-C is a conceptual diagram showing a riffle operation on a deck of cards, where the riffled deck is dispensed from the central compartment to a distribution tray.

In the second operation state, the shuffling process proceeds as previously described, until completed as shown in FIG. 2B. The shuffled deck of cards 90 may dispensed into the receptacle 1830. This is shown in FIG. 17, where FIGS. 2A, B are repeated as FIGS. 17A, B, and the receptacle 1830 is shown in each view. The receptacle 1830 may be positioned beneath either the left-hand 30 or right-hand 20 compartments.

Figure 17B:
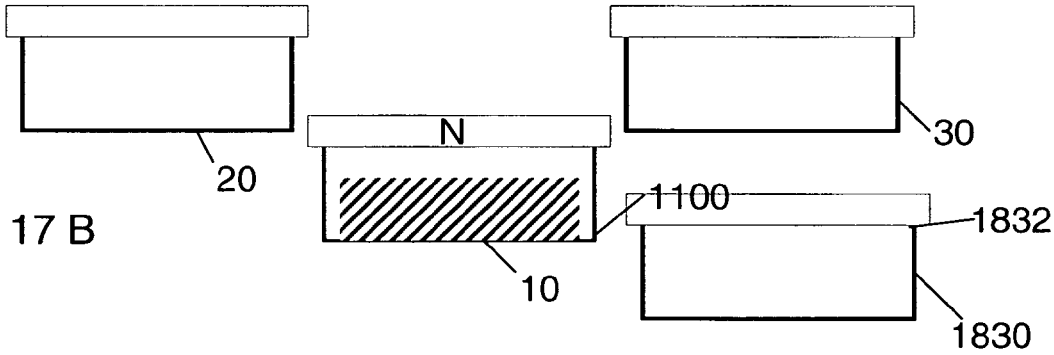
Figure 17C:
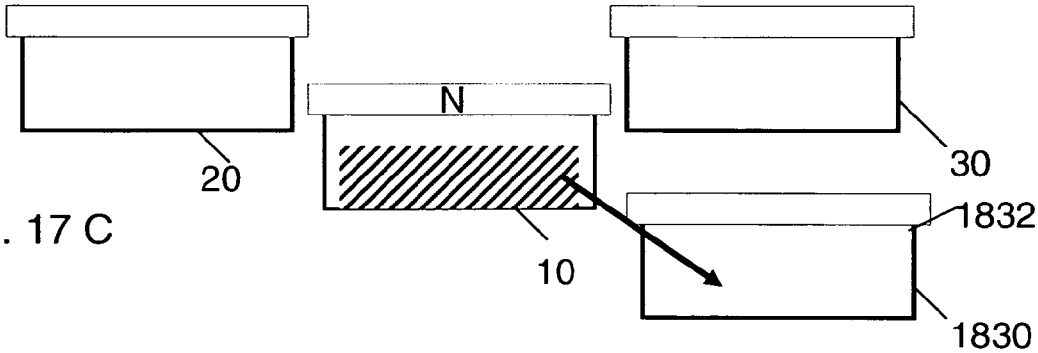

From the position which obtains in FIG. 17B, where the deck of cards is positioned when the shuffling process but the cards have not been placed in a position to be removable, the central compartment 10 is raised to a position as shown in FIG. 17C so that the deck of cards 90 may be dispensed from the central compartment 10 into the receptacle 1830. The central compartment 10 is positioned in height such that a dispensing slot 1100 (shown, for example in FIG. 8B) is positioned above the upper lip 1832 of the receptacle 1830. The central compartment transport mechanism 700 is actuated so as to dispense the deck of cards from the central compartment 10 into the receptacle 1830. Once the cards have been voided from the central compartment 10, the central compartment 10 may be raised to the initial position, such as in FIG. 1A where the central compartment 10 may accept another deck of cards.

Generally, the cards are dispensed through the dispensing slot 1100 as individual cards: that is, one-at-a-time, although the speed of dispensing may give an impression that more that one card is being dispensed. In practice, due to card thickness and coefficient of friction variations, and the tolerances in manufacturing the slot 1100, multiple cards, typically no than two, may be dispensed through the slot. Thus, the term one-at-a time is intended to encompass the situation where cards are occasionally dispensed two-at-a-time. This may also be expressed as "substantially" one-at-a time" without requiring more than one card to be dispensed during a time interval or individual action of the dispensing mechanism.

Figure 18B:
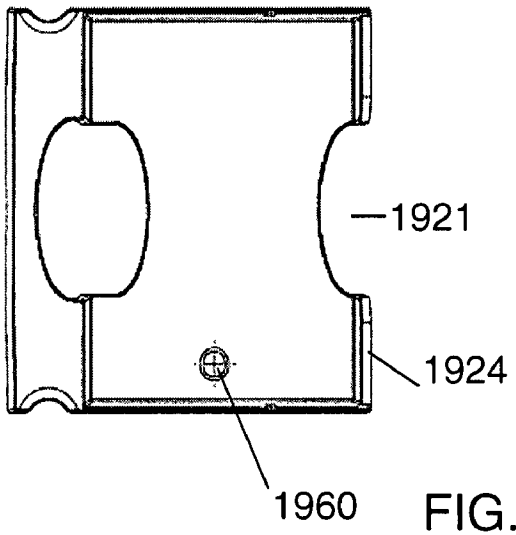
FIG. 18 is a perspective view of a distribution tray showing (A) top; (b) bottom; and, (C) rear aspects.
Figure 18A:
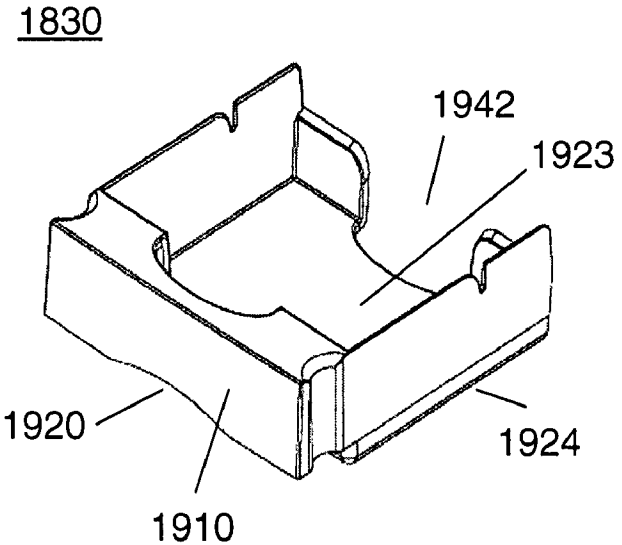
Figure 18C:
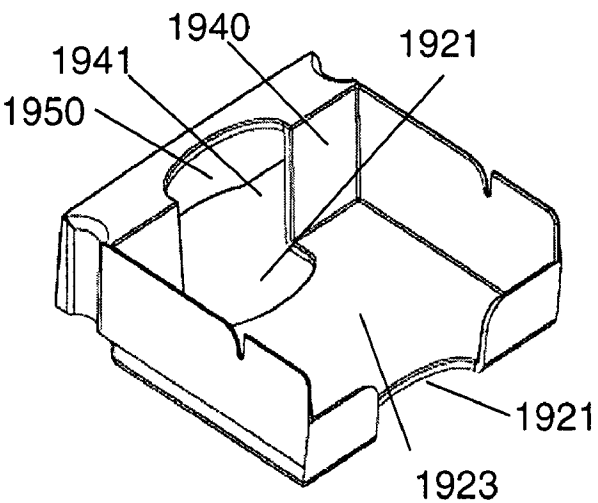

In an aspect, the receptacle 1830 may be a removable compartment such as shown in FIG. 18A-C, which are top-front, bottom and top-rear perspective views, respectively. The receptacle 1830 is sized and dimensioned so as to be insertable into the aperture 1840 and be positionable with respect to the other three compartments of the apparatus as shown in FIG. 17 when inserted into the shuffling device 1. The receptacle has a front fascia 1910 that substantially closes the aperture 1840 when the receptacle 1830 is inserted into the housing 1800; however, a slot 1850 may be disposed below the aperture 1840 so that a user may insert a finger into the slot 1850 and, by pulling on the bottom edge of the fascia 1910, the receptacle 1830 may be slidably removed from the housing 1800. The slot 1850 may extend so as to be present over all of a length of the fascia 1910, or only a portion thereof, and there may be a corresponding relief 1920 in the fascia 1910 so as to facilitate engaging the fascia 1910 by a partially inserted finger.

The bottom surface 1920 of the receptacle 1830 may have a relief provided in opposing side portions there so as to permit the user to insert a fingertip so as to grip a deck of cards resting on the bottom surface 1923 so as to permit a persons fingers to be used to remove the cards as an intact deck. The reliefs 1921 may be arcuate sections as shown in FIG. 18, or may have rectilinear characteristics. The front 1940 and back 1945 surfaces of the receptacle 1930 may be provided with reliefs 1941 and 1942, respectively, which may cooperate with the reliefs 1921 in the bottom surface 1923, and a relief 1950 in a top surface of the fascia 1910 so that the user may access a deck of cards when present in the receptacle 1830. A rim 1924 may be formed around the bottom edge of the receptacle 1830 so as to lift the bottom surface 1923 thereof above the surface of a table (not shown) when the receptacle is placed thereof so as to facilitate the grasping of the deck of cards by the fingers of a used. A similar effect may be achieved by making the bottom surface 1923 with a suitable thickness.

The receptacle 1830 may be slid across the surface of a table or handed to a player of the game of cards so that the player may remove the deck of cards without exposing the bottom card of the deck of cards. The exposure of the bottom card at any time may be undesirable as, when the deck of cards may be ritually cut before dealing, the approximate position after cutting of the deck of the card previously on the bottom of the deck may be estimated by a player of skill.

An aperture 1960 is formed in the bottom surface of the receptacle 1830. A first sensing mechanism, which may include a light source, which may be a light emitting diode (LED), laser, or the like may be disposed so as to project light through the aperture 1960, and a light detector, which may be a photodiode, or other light sensitive electronic component may be disposed so as to oppose the light source, such that the bottom surface 1920 of the receptacle 1830 is disposed therebetween when the receptacle 1830 is fully inserted in the aperture 1840. The spacing of the light source and light detector is such that the receptacle 1830 may be slid between them. When cards are present in the receptacle 1830, the light path between the light source and the light detector is blocked. When cards are not present in the receptacle 1830, the light path between the light source and the light detector is not blocked, and light emitted by the light emitter may be received by the light detector. Thus the presence or absence of cards in the receptacle 1830 can be determined.

A second sensing mechanism, similar to the first sensing mechanism is disposed similarly with respect to the inserted position of the receptacle 1830, except that there is no corresponding hole in the bottom surface 1920 in the light path. In this case, the light path is blocked when the receptacle 1830 is inserted in the housing 1800 through the aperture 1840, whether or not there are cards in the receptacle 1830. When the receptacle 1830 is removed from the housing 1800, the light path of the second sensing mechanism is unblocked and light may be received by the second sensing mechanism. A logic state table of the two sensing mechanisms permits a processor to determine whether the receptacle 1830 is inserted in the housing 1800 or removed, and whether there are cards in the receptacle 1830, or whether the receptacle 1830 is empty.

When the apparatus is configured in the second operation state, for dispensing cards into the receptacle 1830, the central compartment is positioned as shown in FIG. 17C. Prior to dispensing cards from the central compartment 10 into the receptacle 1830, the status of the receptacle 1830 is checked by polling or otherwise determining the state of the sensing mechanisms. When the sensing mechanisms indicate that there are no cards in the receptacle 1830 and that the receptacle 1830 is fully inserted into the housing 1800, cards may be dispensed from the central compartment 10 into the receptacle. When the first sensing mechanism indicates that there are cards in the receptacle 1830, the cards are retained in the central compartment 10 until such time that the first sensing mechanism indicates that there are no cards in the receptacle 1830, and the second sensing mechanism indicates that the receptacle 1830 is inserted in the housing 1800. Once the cards have been dispensed from the central compartment 10 into the receptacle 1930, the central compartment 10 may be raised to a position where another deck of cards may be inserted.

In another aspect, a shuffled deck of cards may remain in the receptacle 1830, while another deck of cards is inserted into the shuffling device 1 and the shuffling process may be completed, except for the dispensing of the cards. The central compartment 10 may then be positioned either in the bottom position as shown in FIG. 17B, or in the dispensing position shown in FIG. 17C until the previously shuffled cards are removed from the receptacle 1830 and the receptacle 1830 is inserted in the housing 1800. The central compartment 10 may be positioned in the dispensing position if it is not already so located, and the shuffled deck of cards dispensed into the receptacle 1830. Thus, a second deck of cards may be processed by the shuffler mechanism prior to removal of the first deck. In an alternative, when the receptacle 1830 is either not present, or contains cards, the central compartment 10 may be raised to the upper position, so that the cards may be removed from through the top aperture 1820.

The deflector bar 110, as shown in FIG. 6B, bridges the opening in the top of the central compartment 10, and moves with the central compartment 10. This type of deflector bar may hamper the insertion of cards into the central compartment through the aperture 1840 formed when the top lid 1810 is raised.

Figure 19A:
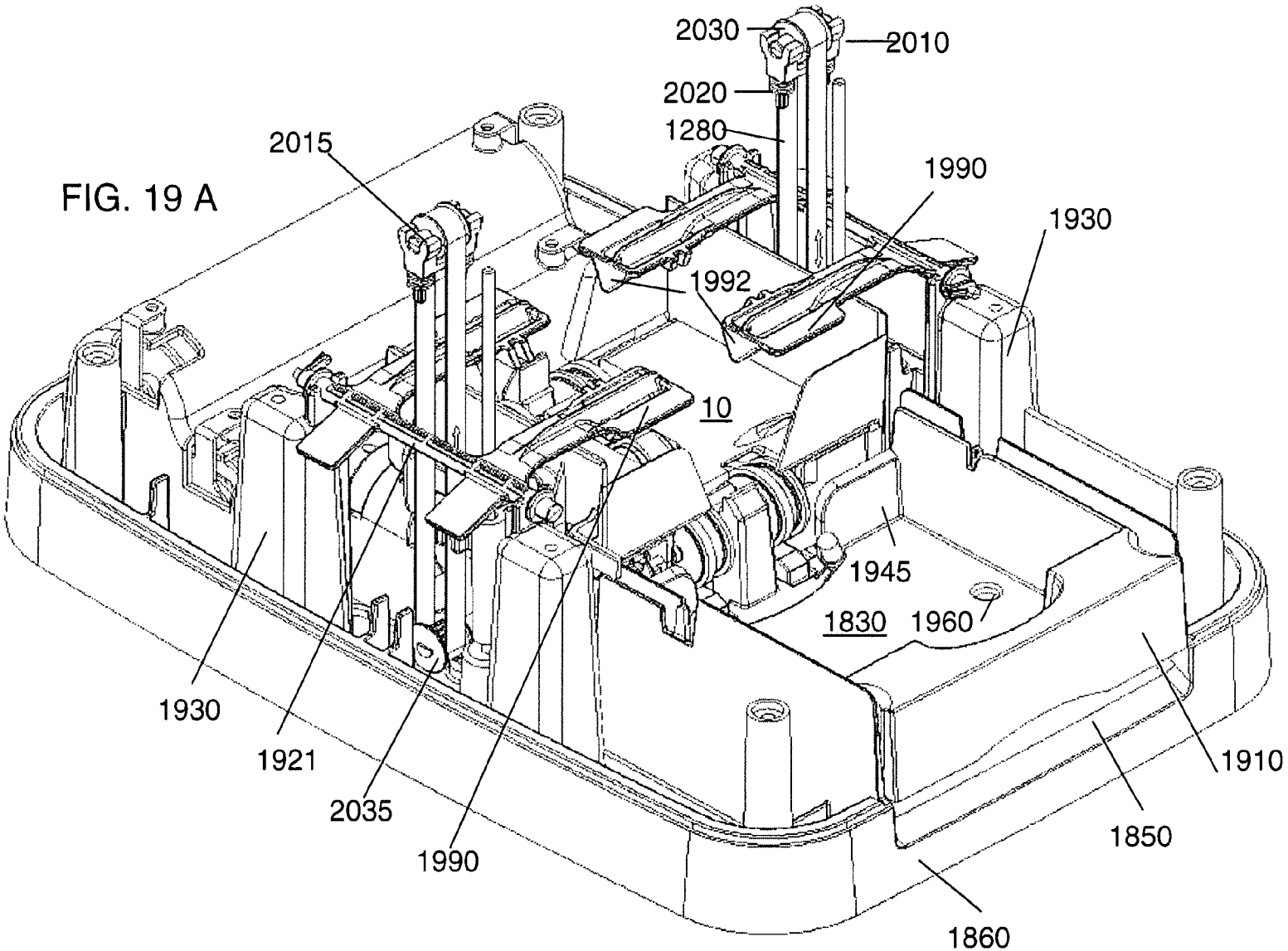
FIG. 19 is a partial perspective view of the device of FIG. 16, with the top cover removed, showing: (A) the central compartment in a lower position; (B) the central compartment in an upper position; and, (C) the central compartment in a partially raised position for dispensing cards into the distribution tray.
Figure 19B:
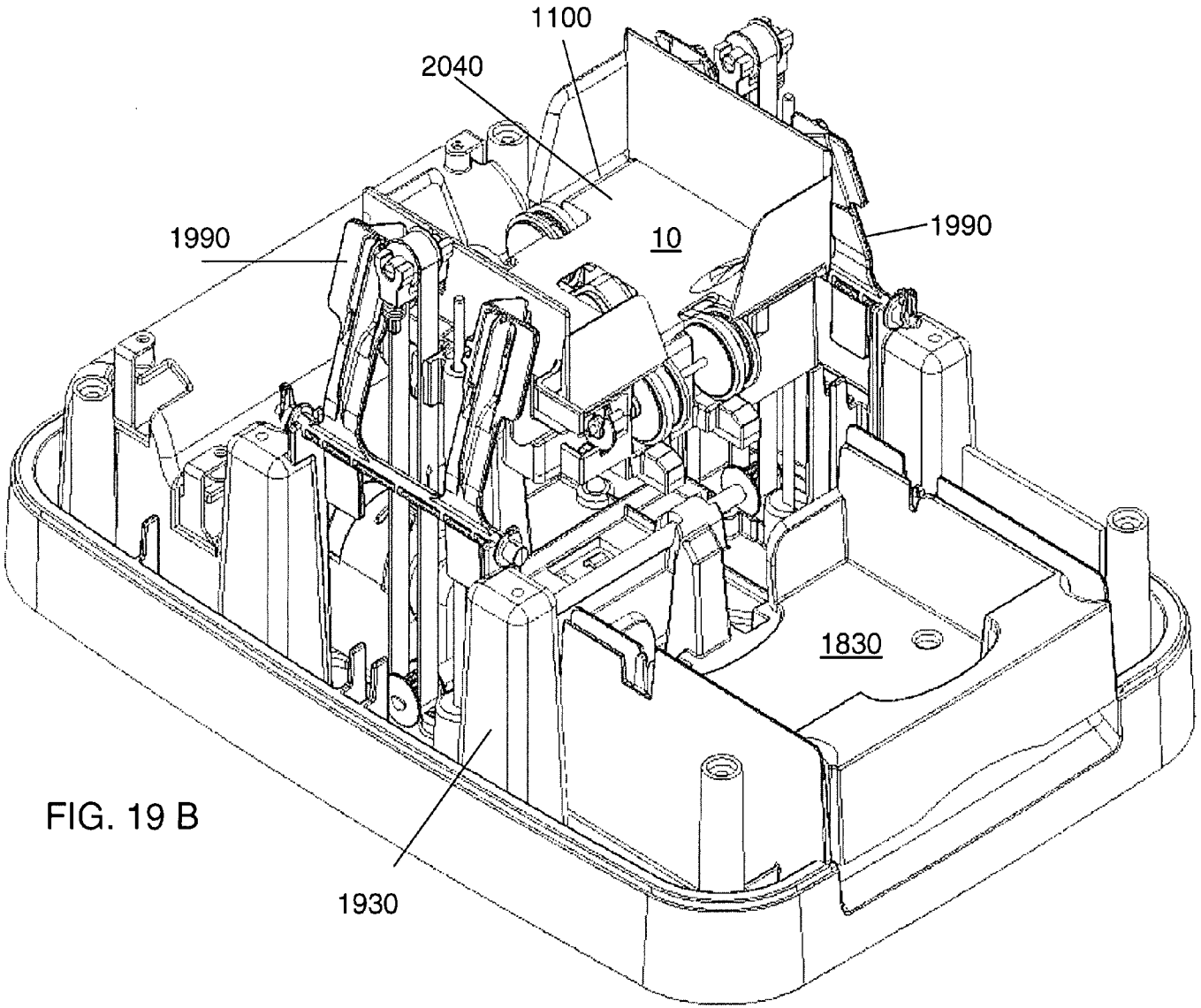
Figure 19C:
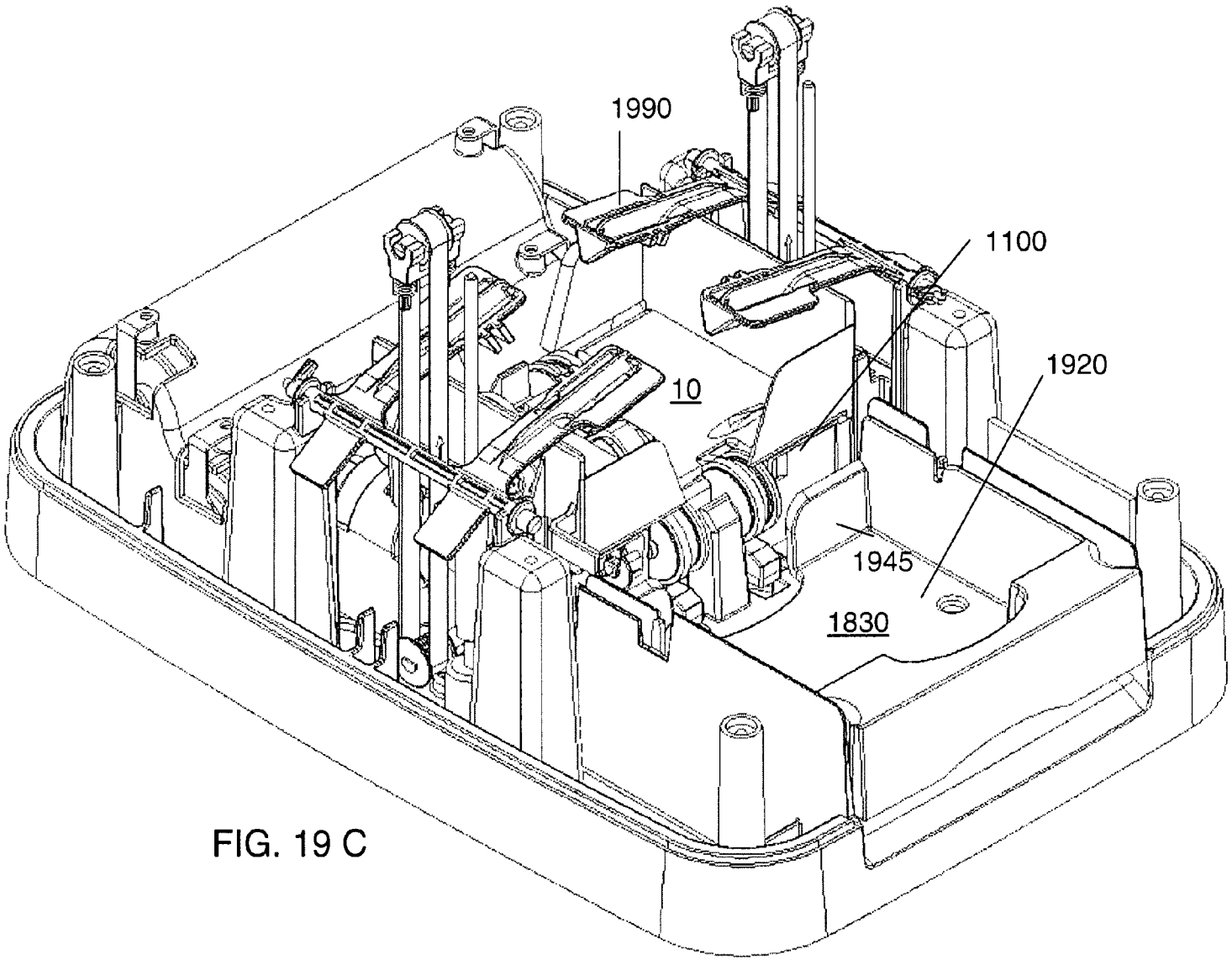

In an example, the deflector bar 110 may not be provided and the operation of deflecting cards may be performed by positionable deflector arms 1990 as shown in FIG. 19A-C. The deflector arms 1990 may be paired and attached to a journalled axle 1991. The axle 1991 may be supported by extensions 1930 from the base 1850 so that the axles 1991 are disposed at opposing ends of the central compartment 10. Extensions 1992 project below the arms 1990 so as to deflect or guide the cards being dispensed from the side compartments 20, 30 into the central compartment 10. Alternatively, the deflector arms 1990 may be journalled with respect to an axle 1991 fixedly mounted to extensions from the base 1930.

FIG. 19 is a partial view of the shuffling apparatus a mounted to the base 1850 of the housing 1800. The side compartments 20, 30 are not shown so that the receptacle 1830, and the movable deflector arms 1990 associated with the central compartment 10, may be seen. FIG. 19B shows the central compartment 10 in an upper position, disposed so as to be proximal to the aperture 1840 in the enclosure 1800, with the deflector arms 1990 themselves positioned by the motion of the central compartment 10 so as to be in a substantially vertical position. In this position, the deflector arms 1990 do not obstruct the placement of a deck of cards into the central compartment 10.

After the cards of the deck of cards has been either cut or stripped into the side compartments 20, 30, the central compartment 10 may be moved to a lower position, shown in FIG. 19A. When the central compartment 10 is lowered, in this case by a belt drive mechanism previously described, the deflection arms 1990 are no longer supported in the substantially vertical position, and the weight distribution of the deflection arms 1990 may be such that the deflection arms 1990 rotate about the axles 1991 so as to be positioned in a substantially horizontal position. The deflection arms 1990 may be urged into this position by an unbalanced weight distribution about the axle 1991, or may be further assisted by a coil spring (not shown) other spring or forcer mechanism. When the deflection arms 1990 are in a substantially horizontal position, they may extend partially across the top opening aperture of central compartment 10, and the extensions 1992 may project into the volume of the central compartment 10. The force with which the deflection arms 1991 resist the impact of cards being dispensed from the side compartments 20, 30 (not shown) into the central compartment 10 is a design parameter that may be related to the relative weight unbalance of the deflection arms 1990 about the axle 1991, and the spring constant of a spring, if any.

When the step of dispensing a shuffled deck of cards into the receptacle 1830 is to be performed, the central compartment 10 may be raised so that the slot 1100 in the bottom side of the central compartment 10 is higher than the bottom surface 1920 of the receptacle 1830 by a distance greater than the height of the deck of cards to be dispensed from the central compartment into the receptacle 1830. This situation is shown in FIG. 19C. The positioning of the central compartment 10 for dispensing the shuffled cards into the receptacle 1830 may not be obviated if the height of the slot 1100 above the bottom surface 1920 of the receptacle 1830 is sufficient when the central compartment is in the position shown in FIG. 19A. This position may be termed the presentation position, and may be the same as the lower position of the central compartment 10 if the dimensions of the various compartments and the spatial relationship therebetween permit the dispensing of cards from the central compartment 10 into the receptacle 1830.

Figure 20:
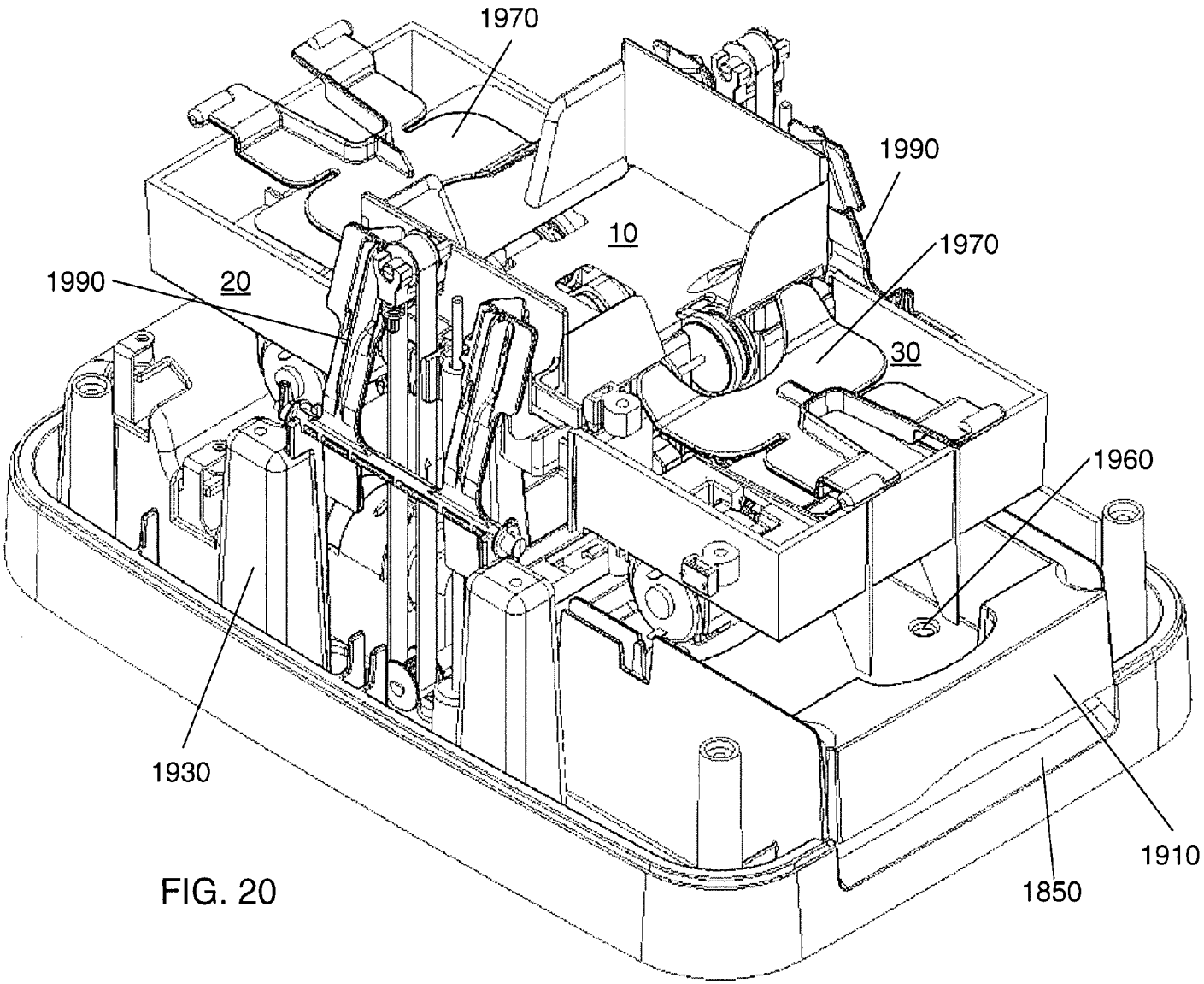
FIG. 20 is a partial perspective view of the device of FIG. 16 with the cover removed, showing the relationship of the central compartment to the left-hand and right-hand compartments when the central compartment is in an upper position.

As shown in another partial perspective view (FIG. 20) of the shuffling apparatus 1, deflection arms 1970 may be provided so as to guide cards dispensed from the central compartment 10 into the side compartments 20, 30. The deflection arms 1970 may be attached to a wall of the side compartment 20, opposite to that where the cards are introduced into the compartment 20, 30 when dispensed from the central compartment 10, as shown, or may be attached to the two opposing side walls of the side compartments 20, 30. Alternatively, in the case of the side compartments 20, 30 which, in this example, may not move in a vertical direction, the deflection arms 1970 may be either journally or fixedly attached to the supporting wall structure or to the base 1860. The deflection arms 1970 may, if needed, serve to deflect the cards being dispensed from the central compartment 10 into the side compartments 20, 30. Alternatively, the deflection arms 1970 may be replaced by the deflection bar 100, or may be omitted.

The shuffling process is controlled by a processor having software or firmware instructions until the deck of cards has been shuffled, using the elemental operations described in FIGS. 1-3. At the conclusion of the shuffling process, all of the cards of the deck of cards 90 are in the central compartment 10, and the central compartment 10 may be in a lower position. (FIG. 19B).

The next step depends on whether the shuffler apparatus of this example is configured in the first operation state (flush mounted) or the second operation state (free standing). In the first operation state, the central compartment 10 is raised to the upper position, which may the same position as was used when the deck of cards 90 was inserted into the shuffling apparatus through the aperture 1840 of the housing 1800. In the second operation state, the deck of cards may be transferred from the central compartment 10 to the receptacle 1830.

The bottom surface of the central compartment 10 may be positioned so that cards dispensed through the slot 1100 at the bottom surface of the central compartment 10 may enter the receptacle 1830 through the top thereof. A deflection arm or bar device may be positioned above the top of the receptacle 1830 so as to guide the cards into the receptacle 1830. It may be similar to the deflector bar 110 or the deflector arms 1930 previously described, and if a deflector device is mounted to a bottom surface of right hand compartment 30, or to the housing, rather than the receptacle 1830 the deflector may not interfere with the removal of the receptacle 1830 from the housing 1800, or the deck of cards from the receptacle 1830.

Prior to dispensing a shuffled deck of cards from the central compartment 10 to the receptacle 1830, after a shuffling operation has been completed, the sensor mechanism associated with the receptacle 1830 is polled. In the situation where the sensor mechanism state table indicates that the receptacle 1830 is present in the housing 1800 and there are no cards in the receptacle 1830, a dispensing operation, similar to that previously described for transfer of cards between the other compartments, may be initiated to transfer the deck of cards from the central compartment 10 in the presentation position to the receptacle 1830.

In the situation where the sensor mechanism state table indicates that the receptacle 1830 is not present in the housing 1800, or the receptacle 1830 has one or more cards therein, the process is suspended with the shuffled deck of cards remaining in the central compartment 10 and the central compartment 10 remaining in the presentation position. The sensor mechanism is periodically polled, or an interrupt process initiated when the state of the sensor mechanism state table changes, and when the state of the sensors indicates that the receptacle 1830 is empty and is inserted in the receptacle 1800, the cards may be dispensed from the central compartment 10 into the receptacle 1830. In this manner, another deck of cards may be shuffled although a deck of cards is present in the receptacle 1830, or the receptacle 1830 has been removed from the housing 1800. A shuffled deck of cards may then be available for dispensing into the receptacle 1830 a soon as the receptacle 1830 is inserted fully into the shuffler apparatus 1.

Once the deck of cards 90 has been dispensed from the central compartment 10 into the receptacle 1830, the central compartment 10 may be raised to an upper position. In the upper position (as in FIG. 19B), the deflection arms 1990 are in a substantially vertical position, and do not obstruct the introduction of a deck of cards into the central compartment 10.

In an alternative, when the receptacle 1830 is either full or removed from the housing 1800, a button may be provided that, when actuated, will result in the central compartment 10 being raised to the upper position so that the deck of cards may be removed through the same aperture 1840 as they were introduced. This is also an end state of the shuffling process when the shuffling apparatus has been configured for installation substantially flush with a table top and a configuration switch has been set to the corresponding position. In this state, the top lid 1810 may be opened and the deck of cards removed from the central compartment 10 through the aperture 1840. Another deck of cards may be introduced into the shuffler and the shuffling process repeated.

In the state where the cards were dispensed into the receptacle 1830, the central compartment 10 may be positioned in the top position, proximal to the lid 1810, and the lid 1810 may be opened and a deck of cards introduced into the central compartment 10.

The central tray 10 may be raised and lowered by an elevator mechanism as has previously described. In an aspect, as shown in FIG. 19A-C, the elevator mechanism may be a belt 1280 disposed so as to engage with a top pulley 2030 and a bottom pulley 2035. The at least the bottom pulley 2035 and the belt 1280 may be toothed, with a pitch such at the pulley 2035 may engage with and drive the belt 1280 so as to raise and lower the central compartment 10. Each of two top pulleys 2030 may be disposed at opposing ends of the central compartment 10 have an axle 2015 that is journally mounted to a structure 2010 acting as a bearing surface. In this example, the structure 2010 is in the form of yoke such that the axle 2015 may be inserted into the structure 2010 from above. The structure 2010 may be supported from below (not shown) so that a spring 2020, which may be a coil spring, or other resilient member may be disposed between the support and the support structure 2010, so that the support structure 2010 is urged upward, and restrained by the belt 1280 engaging the lower pulley 2035, the axle thereof being restrained in a bearing such that it results in tensioning of the belt 1280 between the two pulleys. In normal operation, the tensioned belt engages with the drive pulley 2035, and with the upper pulley 2030, where the upper pulley 2030 may also be toothed. The belt 1280 may engage with the central compartment 10 such as shown in FIG. 11A so as to raise or lower the central compartment 10 depending of the sense of rotation of the drive pulley 2035.

On an occasion, a card jam may occur. This may result from changes in the coefficient of friction of the cards as the deck is used, distortions of the cards, or other causes. The controller may use the sensors for monitoring the transfer of cards between the compartments, for example, to detect and attempt to remedy card jams, and these activities may be successfully restore the shuffler to a proper operational state. During the manual intervention, it may be desirable for the user to able to insert fingers into one or more of the side compartments 20, 30. However, such access may be impeded if the central compartment is in an upper position, such as shown in FIG. 19B, without removing the device cover.

Applying pressure the bottom surface 2040 of the central compartment 10 will, through the attachment of the belt 1280 to the central compartment, exert a downward force on the upper pulley 2030, and the spring 2020 will be compressed such that the supporting structure 2010 will move downward, and the tension on the belt 1280 will be substantially reduced so that the belt teeth may no longer firmly engage with the pulley teeth. This will permit the central compartment 10 to move downward to a lower position. The lower position will depend on the distance that the user has pushed the central compartment 10 down. Once the user has released the pressure on the lower surface 2040 of the central compartment 10, the spring 2020 will re-apply the tension to the belt 1280. The user may then remove or adjust the cards forming the card jam, having gained access to the side compartments 20, 30.

Depending on the software program instructions, the device 1 may be reset by operation actuation of one or more control buttons, or some other action. The pulley 2035 may be operated so as to move the central compartment 10 into a position compatible with the next shuffler operation to be performed. In an example, all of the cards may be removed from the compartments 10, 20, 30, and the device 1 reset such that the central compartment 10 is raised to the uppermost position. The deck of cards 90 may be introduced into the central compartment 10 and a shuffling operation commenced. Other recovery sequences may be performed, using the sensors in the device 1 to determine the presence of cards in each of the compartment, and responding thereto.

In a method of shuffling cards, an apparatus is provided, including a left-hand compartment, a right-hand compartment and a central compartment. The central compartment is adapted to dispense cards into at least one of the left-hand or right-hand compartments, and the left-hand and the right-hand compartments are adapted to dispense cards into the central compartment. After a deck of cards is placed in, or transferred to, the central compartment, a cutting-stripping-riffling (shuffling) operation may be initiated either by an operator pressing a button, or by the device sensing a deck of cards being placed in a compartment thereof. In a cutting-riffling step, the deck of cards is dispensed from the central compartment into the left-hand and right-hand compartments in approximately equal numbers, by dispensing a portion of the deck representing approximately half of the cards into the one side compartment and then dispensing the remainder of the cards into the other side compartment. The relative vertical position of the central compartment with respect to the side compartments may be adjusted such that cards in the side compartments may then be dispensed into the central compartment. Cards are dispensed from the side compartments into the central compartment such that approximately one card from each of the side compartments is alternately dispensed into the central compartment until the cards remaining in the side compartments are exhausted.

Alternatively, the central compartment and the side compartments may be disposed in a staggered cascaded arrangement.

In another step of shuffling cards, a stripping operation may be performed similarly to that of the cutting operation, where the stripping operation may be considered as a modification of the cutting operation. Rather than dispensing approximately half of the deck from the central compartment into, for example, the right-hand compartment, a number of cards, but less than half of the deck is dispensed into the right-hand compartment. Next, a number of cards, but less than half of the deck, is dispensed into the left-hand compartment. This process is continued until there are no cards remaining in the central compartment. The method continues from the state in the method previously described, where the cutting step has been performed, or the cards may be cut after being riffled.

Figure 21:
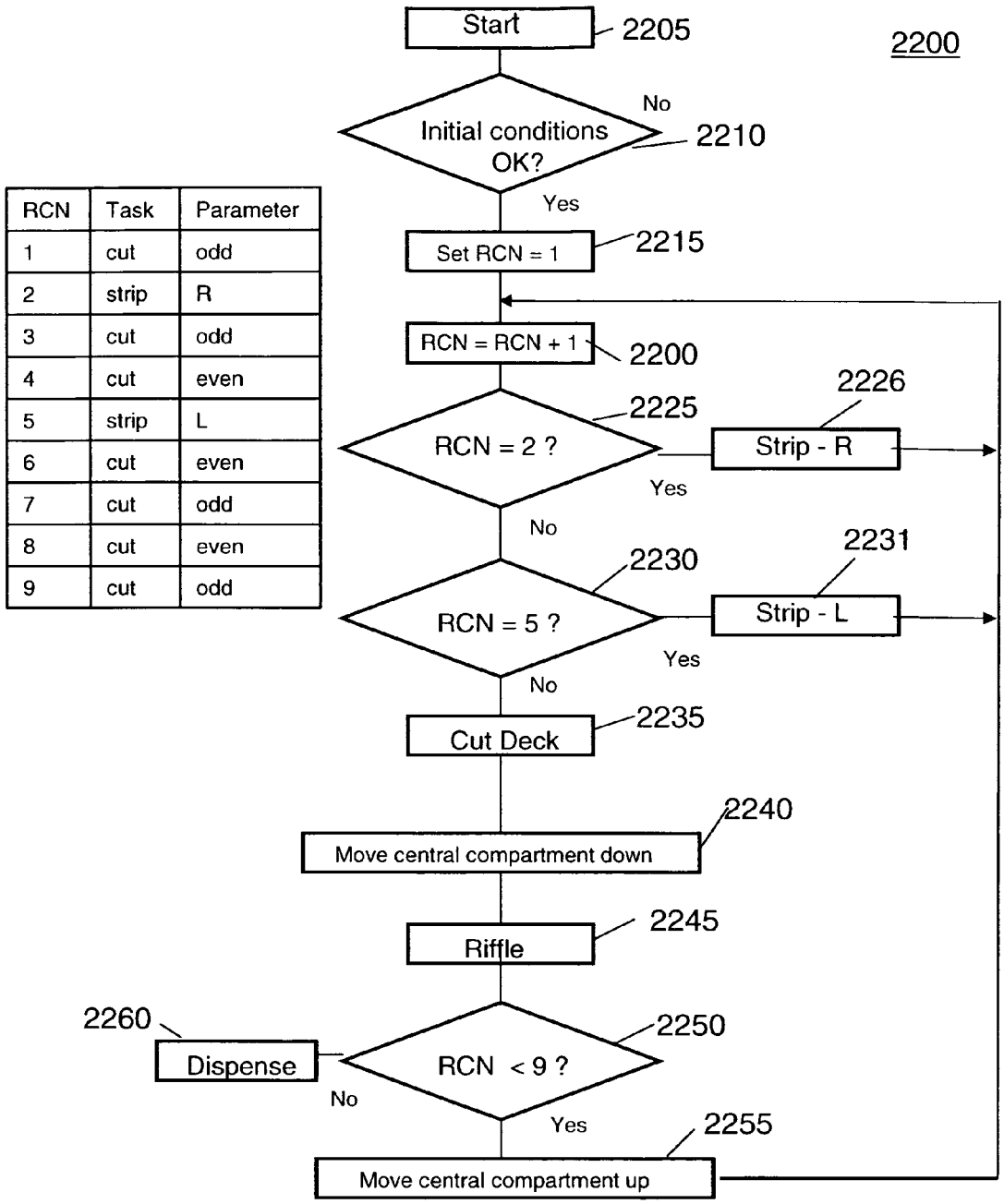
FIG. 21 is a flow chart showing an example of the method of shuffling cards.

In an example of the method of shuffling cards, a top-level flow chart is shown in FIG. 21. This flow chart generally does not include low-level functions such as checking on the status of steps in the process, detecting or rectifying errors, such as card jams, or the like. Rather it is intended to explain the overall control and the function of the apparatus as used to perform the shuffling of a deck of cards under control of a stored program processor, which may be a microprocessor or the like. A person of skill in the art would understand that the sequence of steps, such as cutting, stripping and riffling may be performed in a different sequence from that specifically described herein, and that the number of steps in the shuffling process may also be different. Such a person would also be aware that there are sequences of operations that would lead to unsatisfactory results with respect to effective randomization of the deck of cards, such that the cards would not be considered to be properly shuffled. Such considerations may also be dependent on whether all of the cards were dispensed one-at-a-time, or were occasionally dispensed two-at-a time during a step of the method. The number of cards during a cut or a strip step or part thereof may be controlled so as to be a random number distributed about a nominal number.

The shuffling operation 2200 may be started by the use of a button (step 2205). Alternatively, such a start operation may be initiated, for example, by placing the cards in the central compartment 10 and closing the top cover 1810. Providing that the remainder of the shuffler device is determined to be in a configuration where shuffling operations may be performed (step 2210), a sequence counter RCN is initialized to zero (step 2215). The sequence counter is interpreted with respect to a state table indicating the operation to be performed and any parameters particularizing the operation. An example of a state table may be found in FIG. 21, where 9 operations are defined.

The basic operations are cut or strip or riffle. In addition, cut has parameters odd and even, and strip has parameters L (left) and R (right), which will be explained when the particular subroutines are later described in detail.

The sequence counter RCN is then incremented by unity (step 2220). In step 2225, the value of RCN is tested and, if it not equal to 2, the operation passes to step 2230 where the value is again tested, and if the value is not equal to 5, the operation passes to step 2235 where a cut operation is performed. In accordance with the state table, the cut operation is performed with the parameter "odd". In this example, when the sequence number RCN is odd, the cut parameter is odd, and when the sequence number RCN, the cut parameter is even.

After completion of the cut operation (step 2235), the central compartment is now empty, and is moved to the lower position (step 2240) such that cards may be dispensed from the side compartments to the central compartment. Cards are then dispensed from the side compartments to the central compartment (step 2245), the cards being dispensed substantially one-at-a-time such that cards from the right- and left-hand compartments are substantially alternately deposited in a stack of cards in the central compartment. After all of the cards from the right- and left-hand compartments have been moved to the central compartment, the RCN is tested to see if the shuffling process has been completed (step 2250). Where the RCN is greater than 9, the process has been completed and the cards are dispensed to the user (step 2260). Otherwise the central compartment is moved to the upper position (step 2255) and the process continues.

Returning to step 2220, the RCN is incremented by unity, so that the value of the RCN is now equal to 2. This value is tested in step 2225, and since RCN is equal to 2, the operation proceeds with step 2226 which is a strip-R. The strip process has been previously been described in conjunction with the apparatus, and will subsequently be described as a flow chart of the method.

After completion of step 2226, the process again returns to step 2220, where RCN is again incremented, and has the value 3. As RCN is not equal to either 2 or 5, the process passes through steps 2225 and 2230 and the deck is again cut in step 2235. However in this case, RCN is odd, and the cut process is performed with the odd parameter. The central compartment is then moved to a bottom position (step 2240) and a riffle (mix) performed (step 2245). As RCN is still less than 9, the overall process has not completed, and steps 2255 and 2220 are again performed, resulting in a RCN value of 4.

The process continues with appropriate cut, mix or strip operations, until the value of RCN is 9. At step 2250, a value of RCN equal to or greater than 9 indicates that the basic shuffling process has been completed, and that the cards are ready to be dispensed to the user. Depending on the operation state of the card shuffler (that is, either flush mounted or standing on a surface) and whether the receptacle is either full or not inserted, additional steps may be performed so as to either place the cards in a position where they may be removed from the shuffler device, or are ready to be dispensed when a further condition is sensed. The further condition may be that the dispensing receptacle has been inserted into the shuffler device, or that the receptacle is now empty and may received the shuffled deck of cards.

When the deck of cards is in position to be removed by a user, the shuffler device may enter a state of reduced power consumption, which may be useful in battery-powered situations, or as a "green" or environmentally friendly design. The low-power state may be entered after saving parameters relating to the state of the device, and may be delayed for a preset period of time that may be a multiple of the time period that is ordinarily needed to play a hand of the card game. The electronics may be activated by pushing a start button, as in step 2205, or the equivalent, such as sensing the opening of the top lid.

Figure 22:
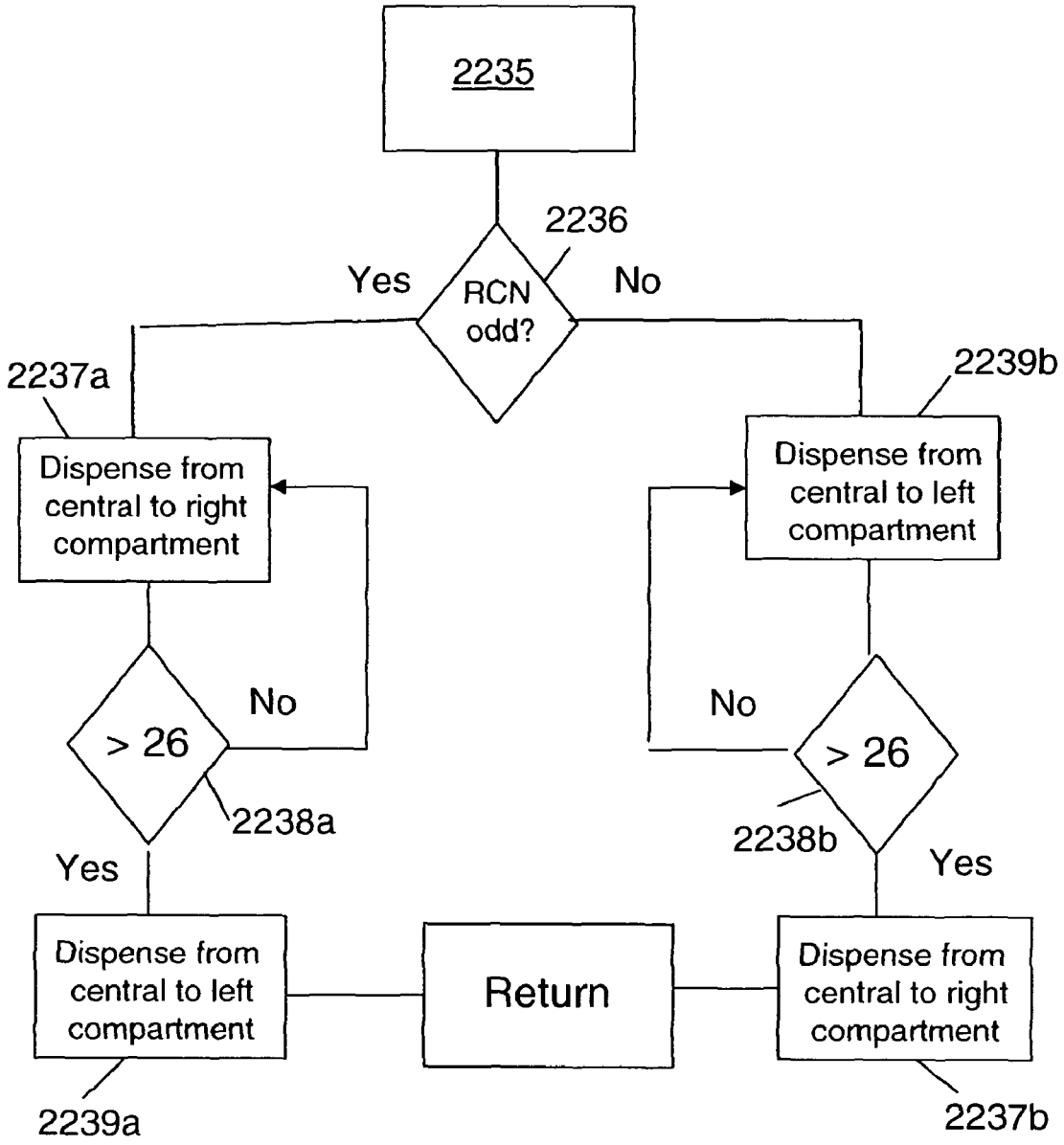
FIG. 22 is a flow chart of the step of cutting cards of the method in FIG. 21; and, FIG. 23 is a flow chart of the step of stripping cards of the method in FIG. 21.

An example of the cutting step is described in more detail in the flow chart shown in FIG. 22. The step of cutting (step 2235) may be performed with either an even or an odd parameter. This is tested in step 2236 based on whether the state table is odd or even for the present RCN value. If the cut-odd is to be performed, step 2237*a* begins to dispense cards into the right-hand compartment until either a time period has expired, or more than a preset number N of cards has been dispensed (step 2238*a*). The number of cards dispensed may be determined in several ways. For, example, the number of rotations of the kicker in the transport mechanism, the number of cards sensed crossing the gap between adjacent compartments, or a time period may be used. More than one of these methods may be used.

The value of N is nominally 26, but may be varied by the operating program, on a cut-to-cut basis, so as to achieve some random or pseudo-random property. Once the number of cards dispensed exceeds N, then the transport mechanism of the central compartment is reversed so that cards are dispensed into the left-hand compartment (step 2239*a*) until the cards remaining in the central compartment have been dispensed. This completes the step of cutting for RCN being an odd number.

When RCN is an even number, the test in step 2236 transfers the process to step 2239*b* where the cards are dispensed from the central compartment to the left-hand compartment until the number of cards dispensed is greater than N, when the remainder of the cards are dispensed into the right-hand compartment (step 2237*b*). This completes the step of cutting for RCN being an even number.

Figure 23:
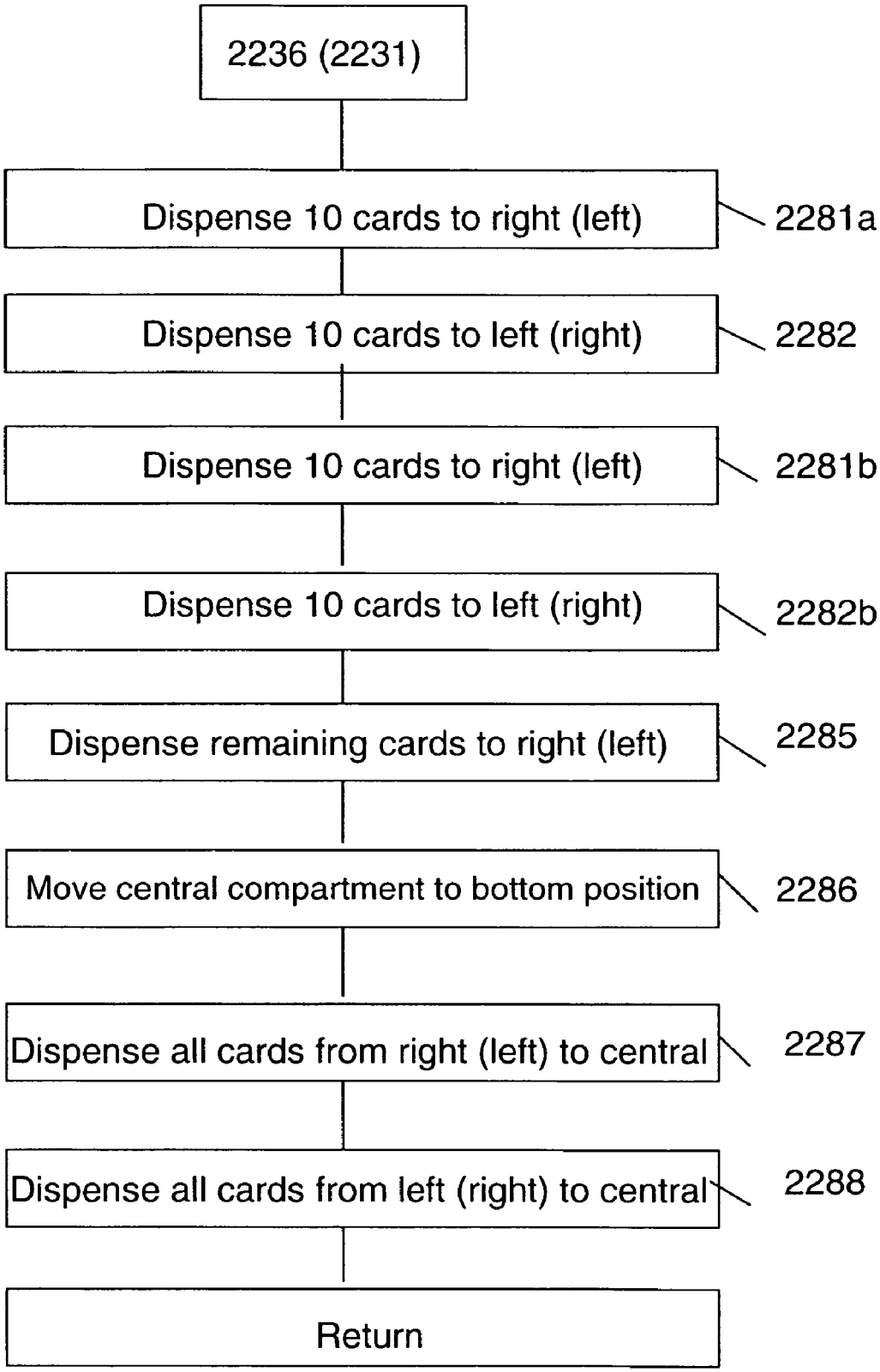

An example of the stripping step is described in more detail in the flow chart shown in FIG. 23. The step of stripping may be performed with either a right (R) (step 2226) or a left (L) (step 2231) parameter. The process for the R parameter (step 2226) is shown, where the steps for the L parameter (step 2231) are shown as alternatives in parentheses. Here a selected number M of the cards, where M is less than about 20 is alternately dispensed from the central compartment to the side compartments until all of the cards in the central compartment are dispensed. The central compartment is then lowered so that the cards in each of the side compartments may be sequentially dispensed into the central compartment to re-form the deck.

In the example for step 2226, a selected number of cards M is dispensed from the central compartment to the right-hand compartment (step 2281*a*). In this example, M may have a value of 10. Once the 10 cards are dispensed, the transport mechanism is reversed so that 10 cards are dispensed into the left-hand compartment (step 2282*a*). The steps 2281*b*, and 2282*b*, are performed, being the same as steps 2281*a* and 2282*a*, respectively, so that about a total of 40 cards are dispensed into the side compartments. The remainder of the cards in the central compartment are then dispensed into the right-hand-compartment (step 2285). The central compartment is then lowered such that cards from the right-hand and left-hand compartments may be dispensed into the central compartment. The cards in the right-hand compartment are then dispensed into the central compartment (step 2287), and the stripping process is completed by dispensing the cards in the left-hand compartment into the central compartment.

While a specific number of cards, 10, were used in the example, the number of cards in each transfer operation may be different, either on a programmed basis or as previously mentioned, when more than one card, or no card, is transferred in each individual transfer operation, due typically to imperfections in the deck of cards, particularly after being used. The programming of the number of cards may be deterministic, or may have a random or pseudo-random characteristic. The term random or pseudo-random in this context means that the variation in the number of cards is bounded, but the specific number is changed, or not changed, in a sequence that a person observing the process would consider to be "random", or unpredictable, with respect to the shuffling of cards and render the resultant shuffled deck of cards effectively random.

The sequence of dispensing cards from the right-hand and left-hand compartments into the central compartment may have the effect of transferring cards from the central region of the un-riffled deck to the top region of the riffled deck. The selection of riffle-left, riffle-right, cut-odd and cut-even and the number of cards dispensed in each step or sub-step may be used to efficiently distribute the cards of a deck so as to achieve an effectively random shuffle. "Effectively random" would be understood by a person of skill in the art to for example, minimize the effectiveness of card counting as a betting strategy in a card game.

The various steps in the methods may be performed in an order other than that described above, and various combinations and repetitions of the elemental steps may be performed.

The dimensions and operation of the device has been generally discussed in terms of a deck of cards, and this may be a deck of 52 playing cards as used in the United States for poker, bridge and the like. Decks of cards sold for use in poker games differ somewhat in dimensions from those used for, for example, bridge, and the shuffling device may be dimensioned to best accommodate a particular type of card, or to accommodate a range of card dimensions.

It has been observed that, in practice, many people, including professional card dealers, may not perform the card shuffling procedure in strict accordance with a mathematical theory. There are, no doubt, a number of reasons for this, including reducing the time needed to shuffle a deck of cards, imperfect execution of the cut, strip or riffle operations, or the like. Yet, such imperfections in the execution of the shuffle procedure are condoned by the players, as the resultant distribution of cards in the decks of cards is not perceived to favor any of the players. This appears to be the situation with respect to professional gambling as well, as any aspect of such shuffling procedures which change the odds, particularly with respect to the dealer, would seem to be unacceptable to the management.

This suggests that shorter shuffling programs may be desired by users, and acceptable to such users. In particular, it is believed an imbalance in the number of cards dispensed from the central compartment into the side compartments during a stripping operation will be effective. For example, a stripping sequence of 8 (R), 3 (L); 8(R), 3 (L); 8 (R), 3 (L); 8 (R), 4 (L); 8 (R), 4(L); or, for example, 3 (R), 8 (L); 8(R), 3 (L); 3 (R), 8 (L); 4 (R), 8 (L); 8 (R), 4(L); or other such stripping operation may be performed. In the first example, the number of cards in the right compartment would be 32 and the number of cards in the left compartment would be 20. The dispensing of cards from the right compartment to the central compartment may be commenced before dispensing of cards from the left compartment to the central compartment. Alternatively, dispensing mechanisms may be started at the same time, but the speed of the dispensing motors may be different, so that the rate of dispensing of cards may be different. Such a riffle operation may be combined with a randomization of the deck cut operation about some central number, so as to achieve an acceptable shuffling result.

Perhaps the number of riffle steps may be reduced to two or three yet yield acceptable results by using unbalanced stripping steps. In such a circumstance, a plurality of stripping patterns, ranging from an even distribution, to, for example, the 8/3 pattern may be used, and one of the patterns chosen pseudo-randomly from the plurality of patterns for each shuffling operation. The examples are intended to be illustrative, and non-limiting as the number of combinations of such operations is an exceedingly large number. The device 1, may have a button to initiate a "full" shuffle or a "speed" shuffle, so that the user may be given a choice between the techniques.

The examples of card shuffling operations have been formulated using the terminology as is known in games of cards so as to explain the operation of the shuffling device. However, this is not intended to limit the operations that may be performed to those having specific names, such as cutting, stripping or riffling. The device may be operated so as to dispense any number of cards from one adjacent compartment to another and, where the compartments are movable with respect to each other, the movements may be in any sequence that is effective to result in a shuffled deck of cards having a distribution of cards that is acceptable to users. For example, the cards may be cut approximately into two equal partial decks in the side compartments, and the cards dispensed from the side compartments into the central compartment by riffling, or by stripping. The relative sizes of the partial decks of cards in the side compartments may be varied for each of the steps in the method, or the like.

The shuffling of multiple decks of cards is known, for example in the games of poker and blackjack or "21", so as to affect the odds of the dealer winning. Other games may use decks of cards having fewer cards, or cards with different dimensions than used in the United States. The device described herein may be operable with these card systems, or be modified so as to perform the randomizing operations described herein. The description herein is intended to cover such modifications, including physical dimensions and operating programs which will now be apparent to a person of skill in the art, having the benefit of this disclosure. As such, the term "deck of cards" is intended to be interpreted to include variants of the dimensions, the number of cards, and the number of decks of cards which may be used.

It will be appreciated that this recitation of elements and functionalities is intended to convey an appreciation for the types of elements and functionalities which may be present, however not all of the elements and functionalities may be found in a specific embodiment, and other elements or functionalities may be used multiple times. Ancillary equipment such as a power supply, which may be batteries, a AC-DC converter (battery eliminator), an AC power supply, or the like, are not shown as they are well known to persons of ordinary skill in the art, as are the various types of motors, display and control interfaces.

Although the present invention has been explained by way of the examples described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A device for shuffling a deck of cards, comprising:

a first compartment, a second compartment, and a third compartment, at each compartment sized and dimensioned to accept at least a portion of a deck of cards, and at least one slot formed in a lower portion of a side wall of each compartment; and a first, a second and a third transport mechanism, associated with the first, the second and the third compartment, respectively; each transport mechanism operative to move a card from a bottom of cards present in the respective compartment through the a slot of the at least one slot to a top of another of the compartments; a portion of each transport mechanism projectable through a bottom surface of the respective compartment, wherein cards of the deck of cards that are present in the respective compartment are urged to contact the projectable portion of the operative transport mechanism by a force of gravity.

2. The device of claim 1, further comprising a card delivery compartment, wherein the cards are dispensed from at least one of the first, the second or the third compartments to the card delivery compartment.

3. The device of claim 2, wherein the card delivery compartment is disposed in an aperture in a side of the device.

4. The device of claim 3, wherein the card delivery compartment includes a tray, sized and dimensioned to receive a deck of cards.

5. The device of claim 4, wherein the tray is removable from the device.

6. The device of claim 1, further comprising a switch located on an exterior surface thereof, the switch operable to configure the device so that the cards are located in one of the card delivery compartment, or one of the first, second or third compartments when the cards are removable from the device after a shuffling process is completed.

7. The device of claim 6, wherein the one of the first, second or third compartments where the cards are located when the cards are removable from the device is disposable proximal to an upper surface of the device housing.

8. The device of claim 7, wherein the compartment containing the cards that are removable is the same compartment used to insert the cards into the device.

9. The device of claim 1, wherein the cards are moved substantially individually.

10. The device of claim 1, wherein the transport mechanism of the second compartment and the transport mechanism of the third compartment are configurable to dispense cards disposable in the second and third compartments such that cards received in the first compartment are arranged such that a first card received from the second compartment is immediately above a first card received from the third compartment and a second card received from the third compartment is immediately above the first card received from the second compartment.

11. The device of claim 1, wherein the cards are inserted and removed from the first compartment through an aperture in an uppermost surface of the device.

12. The device of claim 1, wherein the first compartment is disposed laterally between the second and the third compartments.

13. The device of claim 12, wherein the first compartment is movable vertically with respect to the second and third compartments and the second and third compartments are fixed in a vertical direction.

14. The device of claim 12, wherein the second and third compartments are movable vertically with respect to the first compartment, and the first compartment is fixed in a vertical direction.

15. The device of claim 1, wherein the first, the second, and the third transport mechanisms are controlled by a processor executing a stored computer program.

16. The device of claim 15, wherein the computer program is stored on a non-volatile machine readable medium.

17. The device of claim 1, wherein the projectable portion of each transport mechanism comprises a portion of a roller projecting through a slot in a bottom surface of the corresponding compartment, wherein the axis of the roller is orthogonal to the direction in which cards are dispensed.

18. The device of claim 17, wherein the roller includes a cylindrical device having a segment removed therefrom so as to form a projectable portion, and when the cylindrical device is rotated about an axis, the projectable portion lifts at least one of the cards in the compartment and urges the card towards the slot of the compartment.

19. The device of claim 9, wherein the cards being dispensed are counted by an electro-optical or electromechanical counter.

20. The device of claim 1, where the presence of cards in a compartment is sensed by an electro-optical or electromechanical device.

21. The device of claim 1, where a transfer of cards between compartments is sensed by an electro-optical or electromechanical device.

* * * * *